US007762867B2

(12) United States Patent
Agostini et al.

(10) Patent No.: US 7,762,867 B2
(45) Date of Patent: Jul. 27, 2010

(54) LEVER AND WHEEL ACTIVATED TOY VEHICLES

(75) Inventors: Matthew Felix Agostini, Philadelphia, PA (US); Mary Ellen Gertrude Fosbenner, Riverton, NJ (US); Robert Jude Henry, Riverside, NY (US); Gregory John Sisolak, Mount Laurel, NJ (US); William Francis Michael Dougherty, Oakford, PA (US)

(73) Assignee: Mattel, Inc., El Segundo, CA (US)

( * ) Notice: Subject to any disclaimer, the term of this patent is extended or adjusted under 35 U.S.C. 154(b) by 1137 days.

(21) Appl. No.: 10/846,490

(22) Filed: May 14, 2004

(65) Prior Publication Data

US 2005/0042974 A1 Feb. 24, 2005

Related U.S. Application Data

(60) Provisional application No. 60/471,184, filed on May 16, 2003.

(51) Int. Cl.
*A63H 17/00* (2006.01)

(52) U.S. Cl. ..... 446/431; 446/470; 446/465; 446/93

(58) Field of Classification Search ..... 446/471, 446/470, 93, 94, 95, 269, 424–428, 431, 446/465

See application file for complete search history.

(56) References Cited

U.S. PATENT DOCUMENTS

| | | | | |
|---|---|---|---|---|
| 3,392,484 | A | 7/1968 | Ryan | |
| 3,731,423 | A * | 5/1973 | Cuhel | 446/427 |
| 3,748,780 | A * | 7/1973 | Glass et al. | 446/470 |
| 4,032,295 | A | 6/1977 | Meyer et al. | |
| 4,192,093 | A | 3/1980 | Hamano | |

(Continued)

FOREIGN PATENT DOCUMENTS

| | | | |
|---|---|---|---|
| GB | 2060414 | A * | 5/1981 |

OTHER PUBLICATIONS

"Road Rippers Muscle Boss Turbo", Toy State Industrial Ltd., 63 Mody Road, Kowloo, Hong Kong, 2001 (color photos of toy and package attached labeled Figs. 1-6).

(Continued)

*Primary Examiner*—Gene Kim
*Assistant Examiner*—Urszula M Cegielnik
(74) *Attorney, Agent, or Firm*—Panitch Schwarze Belisario & Nadel LLP

(57) ABSTRACT

A lever activated toy vehicle includes a body, a chassis and a lever. The chassis accommodates the body and has a front wheel and a rear wheel. A motor is disposed within the chassis and is drivingly coupled to at least one of the wheels. The lever is movably supported on the toy vehicle so as to be accessible by a user for movement between a first position and a second position. The toy vehicle further includes a moveable part and an actuator mechanism. The moveable part has at least a portion on the exterior of the body and a portion on the interior of the body. The actuator mechanism is operably coupled with the motor and the moveable part and is configured to move the moveable part from the concealed position to the revealed position after the lever is moved from the first position to the second position.

21 Claims, 26 Drawing Sheets

U.S. PATENT DOCUMENTS

| | | | | | |
|---|---|---|---|---|---|
| 4,194,318 | A | | 3/1980 | Watanabe | |
| 4,382,347 | A | | 5/1983 | Murakami | |
| 4,393,620 | A | | 7/1983 | Murakami | |
| 4,424,978 | A | * | 1/1984 | Kassai | 280/1.13 |
| 4,435,916 | A | | 3/1984 | Iwao et al. | |
| 4,467,556 | A | | 8/1984 | Iwao et al. | |
| 4,585,426 | A | * | 4/1986 | Rasmussen et al. | 446/428 |
| 4,655,727 | A | | 4/1987 | Swisher et al. | |
| 4,674,990 | A | | 6/1987 | Ohno | |
| 4,804,349 | A | * | 2/1989 | Loscalzo et al. | 446/279 |
| 4,925,427 | A | | 5/1990 | Wu | |
| 5,069,649 | A | * | 12/1991 | Wu | 446/470 |
| 5,139,456 | A | | 8/1992 | Chuang et al. | |
| 5,310,379 | A | * | 5/1994 | Hippely et al. | 446/279 |
| 5,389,031 | A | | 2/1995 | Sharpe, III et al. | |
| 5,641,317 | A | | 6/1997 | Huang | |
| 5,735,727 | A | | 4/1998 | Tsai et al. | |
| 5,766,056 | A | | 6/1998 | Tsai | |
| 5,791,967 | A | * | 8/1998 | Yeh | 446/279 |
| 5,807,158 | A | * | 9/1998 | Tsai | 446/470 |
| 5,924,910 | A | | 7/1999 | Liu | |
| 6,468,127 | B1 | * | 10/2002 | Lee | 446/457 |
| 6,520,829 | B1 | | 2/2003 | Temple | |
| 6,527,619 | B1 | | 3/2003 | Agostini et al. | |
| 6,866,557 | B2 | * | 3/2005 | Randall | 446/356 |

OTHER PUBLICATIONS

European Supplemental Search Report dated Aug. 29, 2008 listing three (3) references (one (1) previously cited in an Information Disclosure Statement dated May 14, 2004 and initialed by the Examiner on Dec. 1, 2004).

* cited by examiner

LEVER AND WHEEL ACTIVATED TOY VEHICLES

CROSS-REFERENCE TO RELATED APPLICATIONS

This application claims the benefit of U.S. Provisional Patent Application No. 60/471,184, filed May 16, 2003, entitled "Lever and Wheel Activated Toy Vehicles."

BACKGROUND OF THE INVENTION

The present invention relates generally to activation devices for toy vehicles and for toy vehicle accessories and, more particularly, to lever and wheel activated toy vehicles and toy vehicle accessories.

Toy vehicles, such as toy cars and trucks, are widely available in various configurations including those operated by a small electric motor or purely mechanical vehicles with wheels that spin freely ("free-wheeling"). Some of these toy vehicles include a mechanized accessory or body part which gives the toy added novelty for the user. For example, U.S. Pat. No. 4,655,727 ("Swisher et al.") discloses a purely mechanical toy vehicle having a base or chassis with six freely spinning wheels and a top or body portion which is pivotally linked to the base of the toy vehicle by a pair of standoffs. The Swisher toy vehicle provides an external handle that is basically an extension of a lower part of the link which allows the user to rotate the entire top portion of the vehicle to a position higher than the base to give the toy vehicle a different overall appearance.

Another toy vehicle that is purely mechanical and that has a mechanized accessory is described in U.S. Pat. No. 6,527,619 B1 ("Agostini et al."). Agostini discloses a toy fire truck of the free-wheeling variety that has a projectile launching tube rotatably mounted to the roof. The projectile launching tube is accompanied by a launching handle and a sound effect control handle. The launching handle is used to compress and release a launching spring. The sound effect control handle is used to raise and lower the launching tube and provides various buttons for initiating sound effects.

Yet another more complicated, purely mechanical toy vehicle is described in U.S. Pat. No. 3,392,384 ("Ryan et al."). Ryan discloses a rocket launching truck where the launcher is located on the bed of the truck and is capable of being raised and lowered. A lever is provided which is used to actuate a spring and flywheel system for both launching a toy rocket and for propelling the toy truck.

Another variety of toy vehicle includes a small motor and gear system for propulsion and for operation of vehicle accessories, such as the toy fire truck disclosed in U.S. Pat. No. 5,766,056 ("Tsai"). Tsai discloses a fire truck having a ladder that raises and lowers automatically by a power train that also causes a miniature fireman figure to scale and descend the ladder. The same power train also provides propulsion for the fire truck by way of a set of small drive wheels and causes other fireman figurines to partially rotate out the sides of the doors.

What is needed but not provided for in the prior art is a lever or wheel activated toy vehicle having a moveable part which exposes or reveals various hidden surfaces and/or figurines during play. What is also needed and not provided by the prior art is a lever or wheel activated toy vehicle having a moveable part which reveals such hidden surfaces or figurines during play automatically and/or sequentially.

BRIEF SUMMARY OF THE INVENTION

Briefly stated, in one aspect, the present invention is a lever activated toy vehicle including a body, a chassis and a lever. The body has a front end, a rear end, an interior and an exterior. The chassis accommodates the body and has at least a front wheel proximate the front end and a rear wheel proximate the rear end. The motor is disposed within one of the body and the chassis and is drivingly coupled to at least one of the wheels. The lever is movably supported on one of the chassis and the body of the toy vehicle so as to be accessible by a user for movement between a first position and a second position. The toy vehicle further includes a moveable part and an actuator mechanism. The moveable part has at least a portion on the exterior of the body and a portion on the interior of the body. The moveable part is supported on at least one of the chassis and the body for movement between a concealed position and a revealed position. The actuator mechanism is operably coupled with the motor and the moveable part. The actuator mechanism is configured to move the moveable part from the concealed position to the revealed position by power from the motor after the lever is moved from the first position to the second position and is configured to move the moveable part from the revealed position back to the concealed position after a predetermined time.

In another aspect, the present invention is also another lever activated toy vehicle including a body, a chassis and a lever. The body has a front end, a rear end, an interior and an exterior. The chassis accommodates the body and has at least a front wheel proximate the front end and a rear wheel proximate the rear end. The lever is movably supported on one of the chassis and the body of the toy vehicle so as to be accessible by a user for movement between a first position and a second position. The toy vehicle further includes a moveable part, an actuator mechanism and a moveable accessory. The moveable part has at least a portion on the exterior of the body and a portion on the interior of the body. The moveable part is supported on at least one of the chassis and the body for movement between a concealed position and a revealed position. The actuator mechanism is operably coupled with the lever and the moveable part. The actuator mechanism is configured to move the moveable part from the concealed position to the revealed position by mechanical translation after the lever is moved from the first position to the second position and is configured to move the moveable part from the revealed position back to the concealed position. The moveable accessory is operably coupled with one of the lever and the actuator mechanism. The moveable accessory is supported on at least one of the chassis and the body for movement between a stored position and an operated position.

In yet another aspect, the present invention is a wheel activated toy vehicle including a body, a chassis and a crank wheel. The body has a front end, a rear end, an interior and an exterior. The chassis accommodates the body and has at least a front wheel proximate the front end and a rear wheel proximate the rear end. The crank wheel is movably supported on one of the chassis and the body of the toy vehicle so as to be accessible by a user for movement between a first position and a second position. The toy vehicle further includes a moveable part, an actuator mechanism and a moveable accessory. The moveable part has at least a portion on the exterior of the body and a portion on the interior of the body. The moveable part is supported on at least one of the chassis and the body for movement between a concealed position and a revealed position. The actuator mechanism is operably coupled with the crank wheel and the moveable part. The actuator mechanism is configured to move the moveable part from the concealed position to the revealed position by mechanical translation as the crank wheel is rotated from the first position to the second position and is configured to move the moveable part from the revealed position back to the concealed position as the crank wheel is rotated from the second position to the first position. The moveable accessory is operably coupled with one of the crank wheel and the actuator mechanism. The moveable accessory is supported on at least one of the chassis and the body for movement between a lowered position and a raised position.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1A:
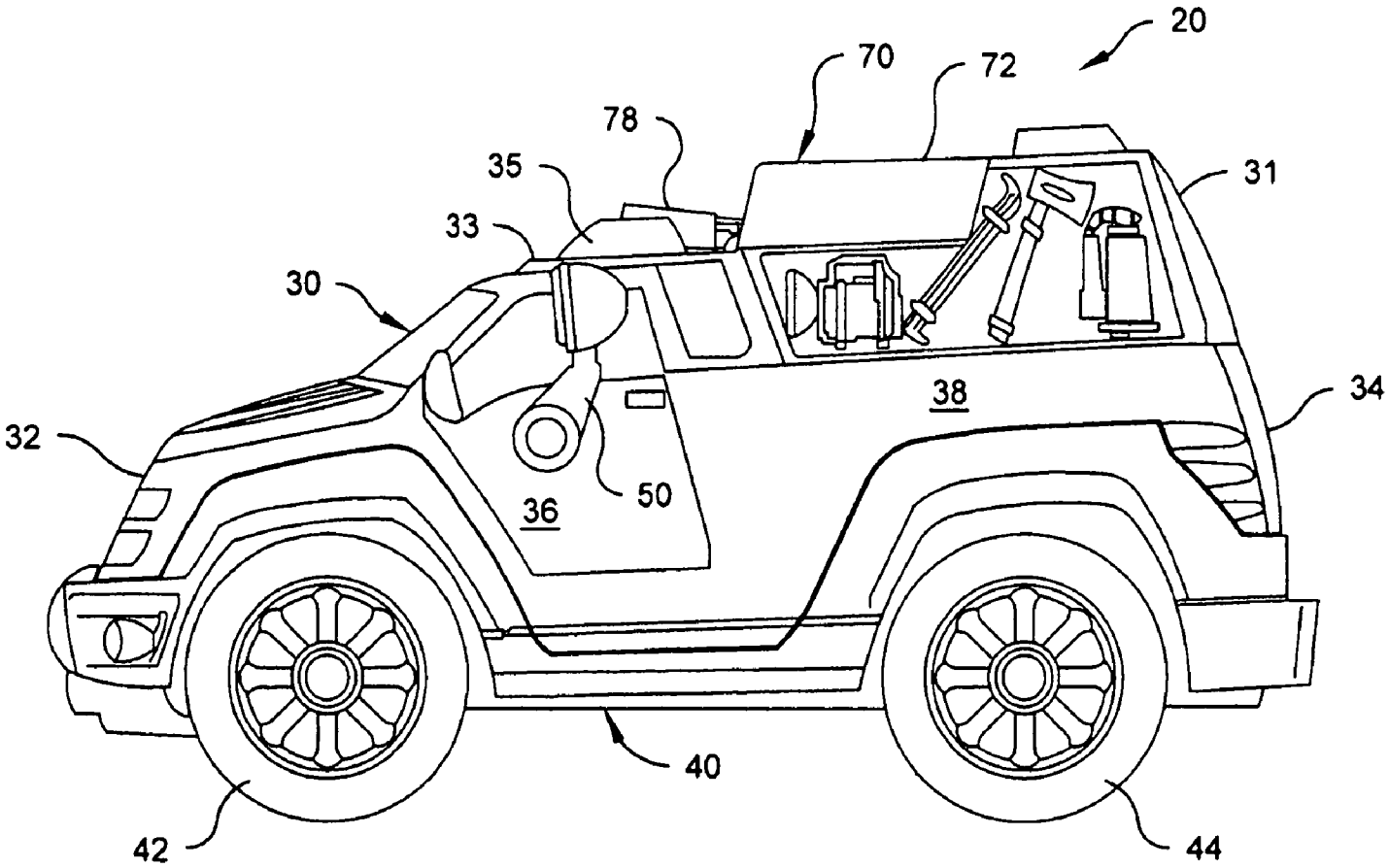
FIG. 1A is a perspective view of a first preferred embodiment of a lever activated toy vehicle in accordance with the present invention.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the object discussed and designated parts thereof. The terminology includes the words above specifically mentioned, derivatives thereof and words of similar import. Additionally, the word "a" as used in the claims and in the corresponding portions of the specification, means "one or more than one."

Generally speaking, the present invention comprises toy vehicles which perform various mechanized functions upon user actuation of a lever or a wheel and/or combinations thereof. In the drawings, like numerals are used to indicate like elements throughout.

Figure 1B:
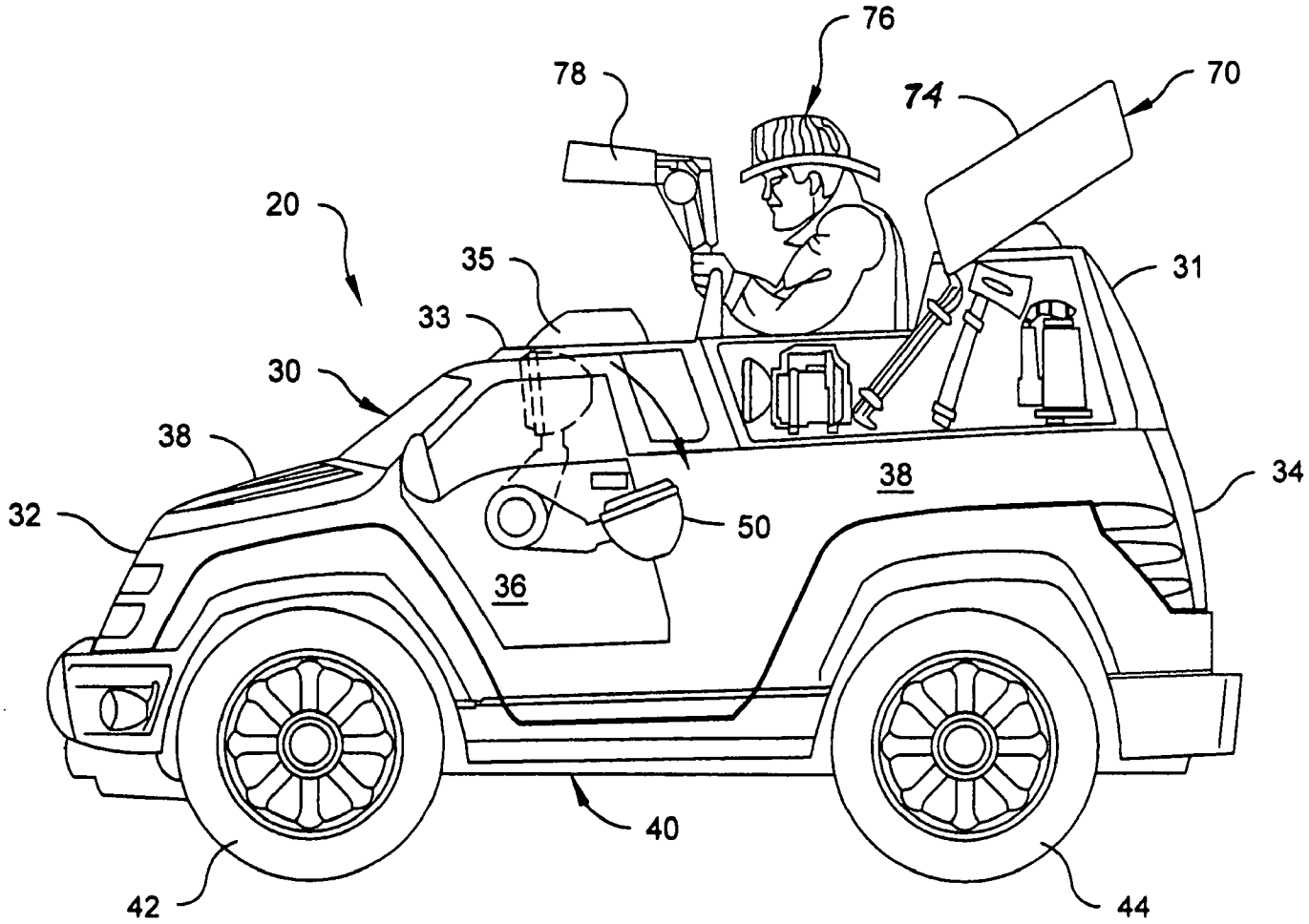
FIG. 1B is a perspective view of the toy vehicle of FIG. 1A in a partially activated position.
Figure 2:
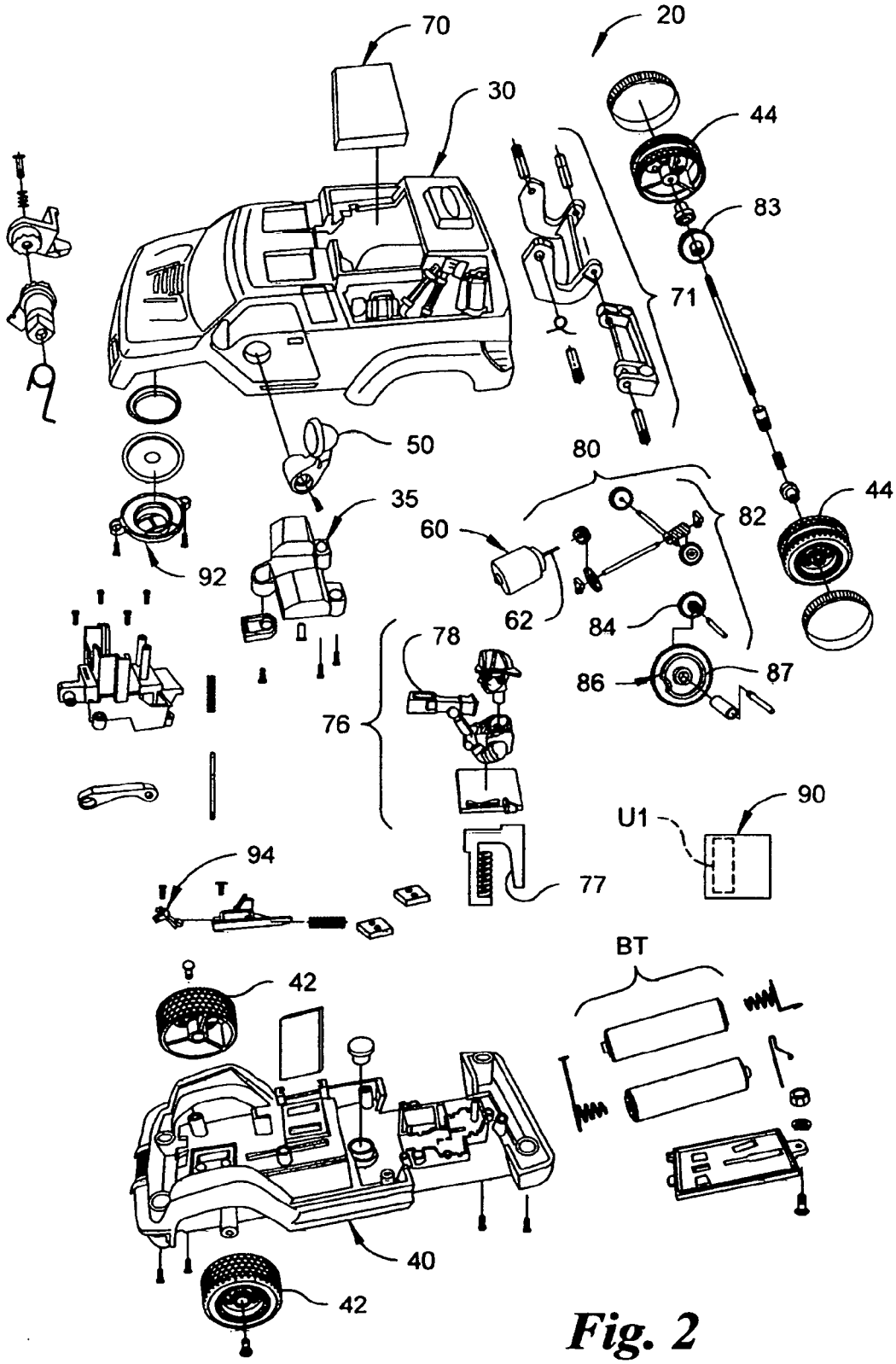
FIG. 2 is an exploded view of the toy vehicle of FIGS. 1A-1B.

Referring to FIGS. 1A-1B and 2, a first preferred embodiment of the present invention comprises a lever activated toy vehicle 20 including a body 30, a chassis 40 and a lever 50. The body has a front end 32, a rear end 34, an interior (within the body 30) and an exterior 38. The chassis 40 accommodates the body 30 and has at least a front wheel 42 proximate the front end 32 and a rear wheel 44 proximate the rear end 34. Preferably, the chassis 40 has two front wheels 42 and two rear wheels 44. The body 30 and the chassis 40 may give the toy vehicle 20 the overall appearance of a service vehicle such as a police vehicle, a fire vehicle, a construction vehicle and the like. In the presently preferred embodiment, the toy vehicle 20 has the overall appearance of a fire truck and includes a flashing light bar 35 on the roof 33.

A motor 60 (FIG. 2) is disposed within one of the body 30 and the chassis 40 and is drivingly coupled to at least one of the wheels 42, 44. Preferably, the motor 60 is a direct current (DC) motor. Optionally, the motor 60 is a reversible motor. The lever 50 is movably supported on one of the chassis 40 and the body 30 of the toy vehicle 20 so as to be accessible by a user for movement between a first position (FIG. 1A) and a second position (FIG. 1B). In the presently preferred embodiment, the lever 50 has the appearance of a spotlight and is disposed on a driver-side door 36 of the toy vehicle 20. The toy vehicle 20 further includes a moveable part 70 and an actuator mechanism 80 (FIG. 2). The moveable part 70 has at least a portion on the exterior 38 of the body 30 and a portion on the interior 37 of the body 30. The moveable part 70 is supported on at least one of the chassis 40 and the body 30 for movement between a concealed position (FIG. 1A) and a revealed position (FIG. 1B).

The actuator mechanism 80 is operably coupled with the motor 60 and the moveable part 70. The actuator mechanism 80 is configured to move the moveable part 70 from the concealed position to the revealed position by power from the motor 60 after the lever 50 is moved from the first position to the second position and is configured to move the moveable part 70 from the revealed position back to the concealed position after a predetermined time has elapsed. As shown, the actuator mechanism 80 comprises a gear train or transmission 82 which is in mesh with a shaft 62 of the motor 60. Preferably, the predetermined time is based upon a mechanical cam 86 operably coupled to the actuator mechanism 80. When the user operates the lever 50, a switch 94 is closed and the motor 60 begins to operate thereby causing the mechanical cam 86 to rotate and hold or maintain the switch 94 even after the lever 50 is released. When the mechanical cam 86 rotates past its timing lobe 87, the switch 94 is no longer maintained and power is removed from the motor 60. Of course, other means could be utilized to latch the switch 94 after the lever 50 is released including using a latching timer relay, a timer integrated circuit (IC), a counter IC, a microprocessor and the like without departing from the invention.

The gear train 82 includes at least one power take-off 84 for driving ancillary devices such as the cam 86. The gear train 82 may include a plurality of power take-off devices 84 for driving a plurality of ancillary devices like the cam 86. Alternatively, a single power take-off 84 can be configured to drive a plurality of ancillary devices like the cam 86 so that a plurality of moveable parts 70 can be moved from a concealed position to a revealed position in concert. It is further contemplated that there may be a combination of cams 86 each having a unique time-delay in order to move each of the plurality of moveable parts 70 in a predetermined operational sequence without departing from the present invention.

The moveable part 70 of the lever activated toy vehicle 20 has a first surface 72 visible on the vehicle 20 in at least the concealed position and a second surface 74 visible on the vehicle 20 only in the revealed position. Each of the first and second surfaces 72, 74 has sufficiently different features to differentiate from the other of the first and second surfaces 72, 74. In the presently preferred embodiment, the moveable part 70 is a hatch or a portion of a "truck cap" 31 that is hingedly connected to the remaining portion of the truck cap by a hinge mechanism 71. Of course, the moveable part 70 could also be a door, a window, a cap, a cab, a roof, a sun roof, a moon roof, a trunk lid, a hatchback and the like without departing from the spirit and scope of the present invention.

The lever activated toy vehicle 20 further includes a figurine 76 disposed at least partially within the body 30 of the vehicle 20. The figurine 76 is hidden from view when the moveable part 70 is in the concealed position (FIG. 1A) and the figurine 76 is viewable when the moveable part is in the revealed position (FIG. 1B). Preferably, the figurine 76 moves (or "pops-up") from a withdrawn position to an extended position when the moveable part moves from the concealed position to the revealed position. In the presently preferred embodiment, the figurine 76 has the overall appearance of a fireman, or at least the upper torso, arms and head of a fireman. Additionally, the fireman figurine 76 is aiming a water cannon or nozzle 78 which also moves from a first position to a second position in concert with the moveable part 70 and the fireman figurine 76. The figurine 76 includes a ramped surface 77 (FIG. 2) protruding beneath the figurine 76 and configured to engage the lobe 87 of the cam 86. The ramped surface 77 rides along the lobe 87 during operation thereby causing the figurine 76 to emerge.

The lever activated toy vehicle 20 further includes a control circuit 90 (FIG. 2) having a battery or batteries BT mounted within at least one of the body 30 and the chassis 40. The lever activated toy vehicle 20 also includes a sound generator 92 electrically connected to the control circuit 90. The light bar 35 is also electrically connected to the control circuit 90. When the switch 94 is closed, the batteries BT provide power to the motor 60 and the control circuit 90. Preferably, the control circuit 90 includes a sound synthesizer controller U1 which is capable of storing control programs and prerecorded sound bytes for outputting to the sound generator 92. The control circuit 90 energizes the light bar 35 causing it to illuminate or flash and simultaneously drives the sound generator 92 by playing sound bytes, music, sirens, horns and the like.

In use, a user initially moves the lever 50 from the first position to the second position momentarily. Once the lever 50 reaches the second position, the switch 94 is made thereby allowing the batteries BT to supply power to the motor 60 and the control circuit 90, as mentioned above. The motor 60 begins to rotate which, in turn, drives the gear train 82. The gear train 82 drives the mechanical cam 86 by way of the power take-off 84 causing the lobe 87 of the cam 86 to engage the switch 94 for the predetermined time which is determined by the shape or length of the lobe 87. The gear train 82 also drives at least one of the wheels 42, 44 by way of a drive gear 83. The result is that the lever activated toy vehicle 20 drives forward about four to six feet while the moveable part 70 moves from the concealed position shown in FIG. 1A to the revealed position shown in FIG. 1B, and subsequently move the moveable part 70 from the revealed position back to the concealed position just prior to the end of the run of the toy vehicle 20. When the moveable part (hatch) 70 pops open, the previously unseen fireman figurine 76 emerges or pops-up. As the mechanization sequence ends, the figurine 76 descends back into the compartment and the moveable part 70 closes over the figurine 76. The actuation of the moveable part 70 and the figurine 76 is completely automatically mechanized and does not require any additional manipulation by the user after the initial actuation of the lever 50.

Figure 3A:
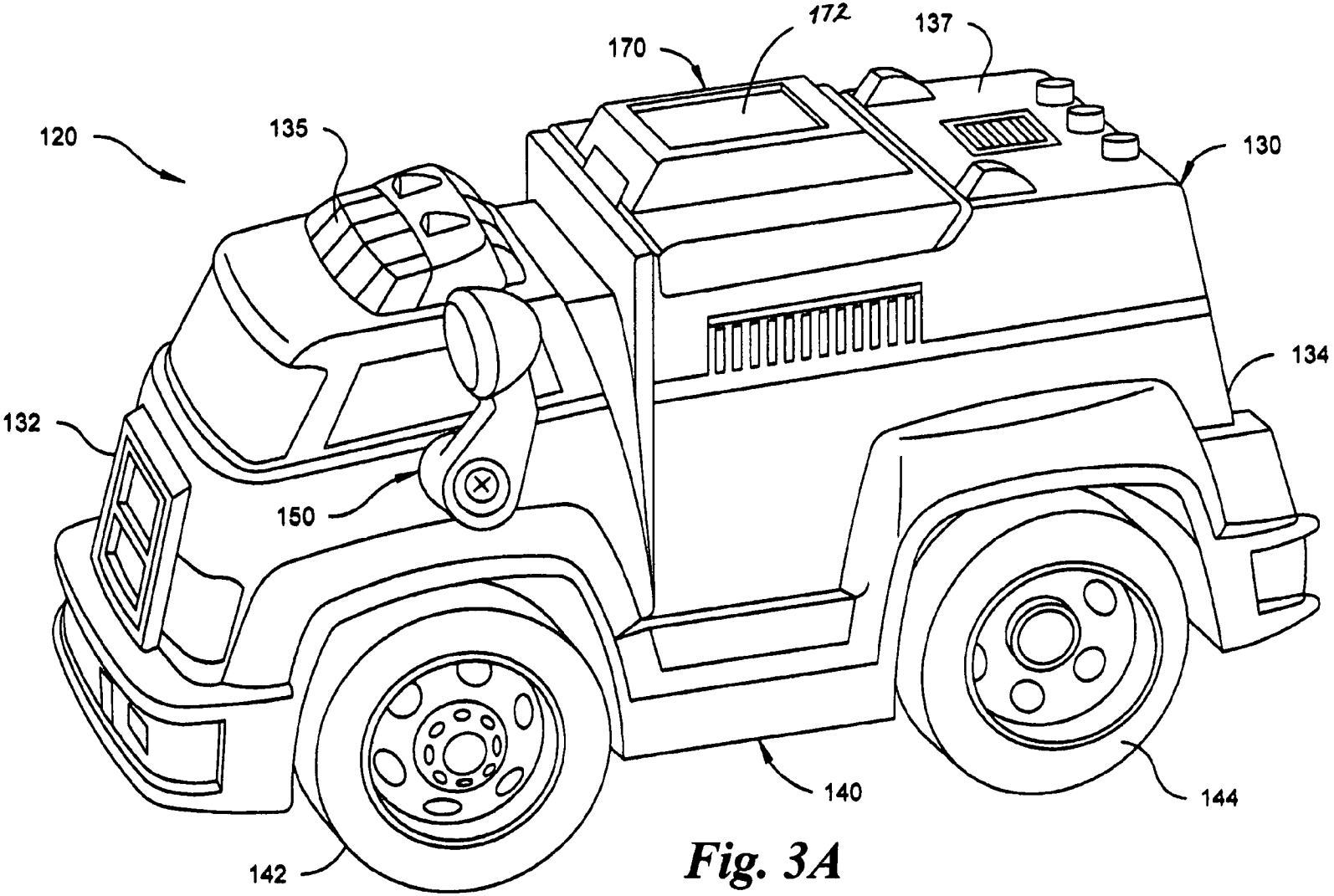
FIG. 3A is a perspective view of an alternate of the first preferred embodiment of FIGS. 1A-1B.
Figure 3B:
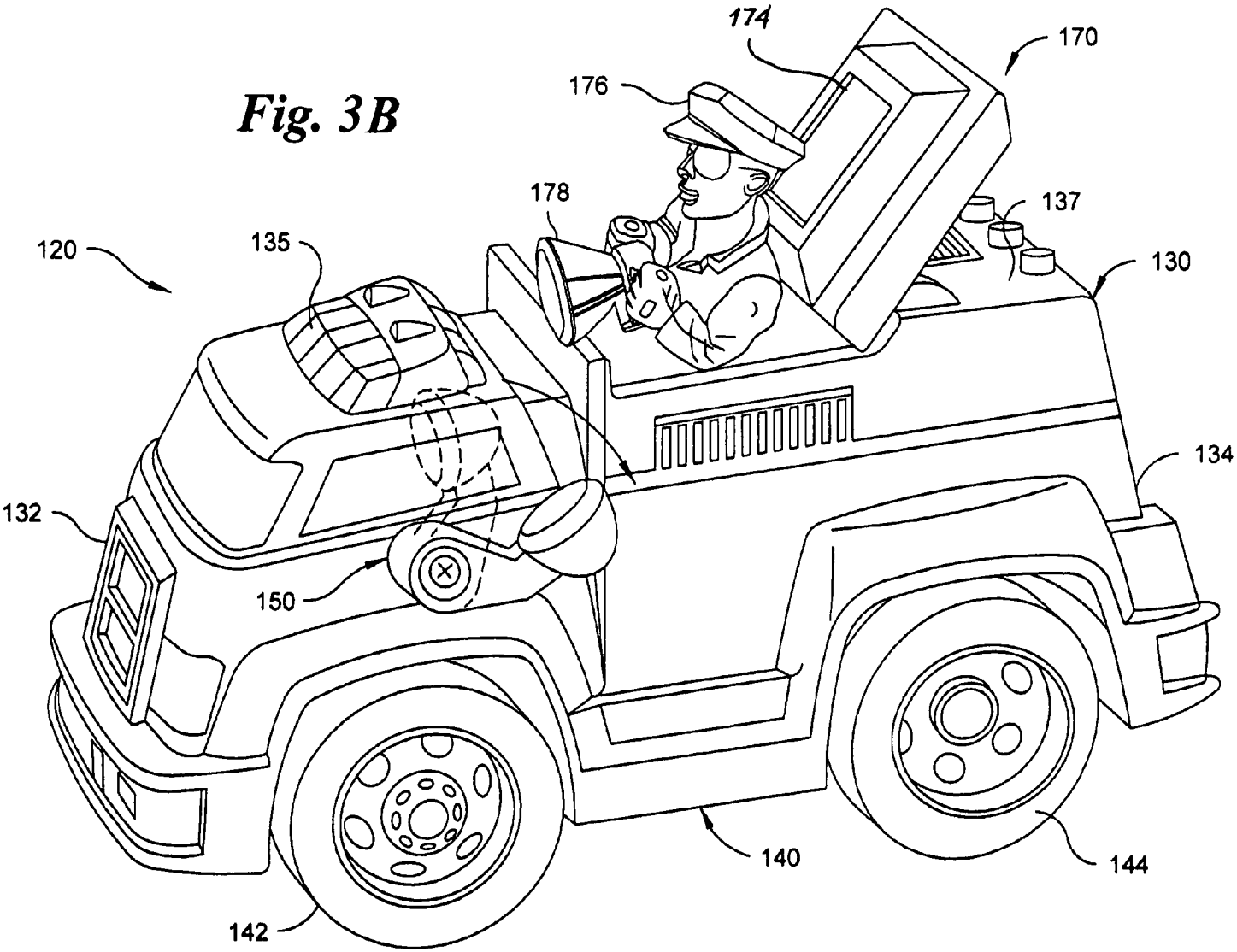
FIG. 3B is a perspective view of the toy vehicle of FIG. 3A in a partially activated position.
Figure 4:
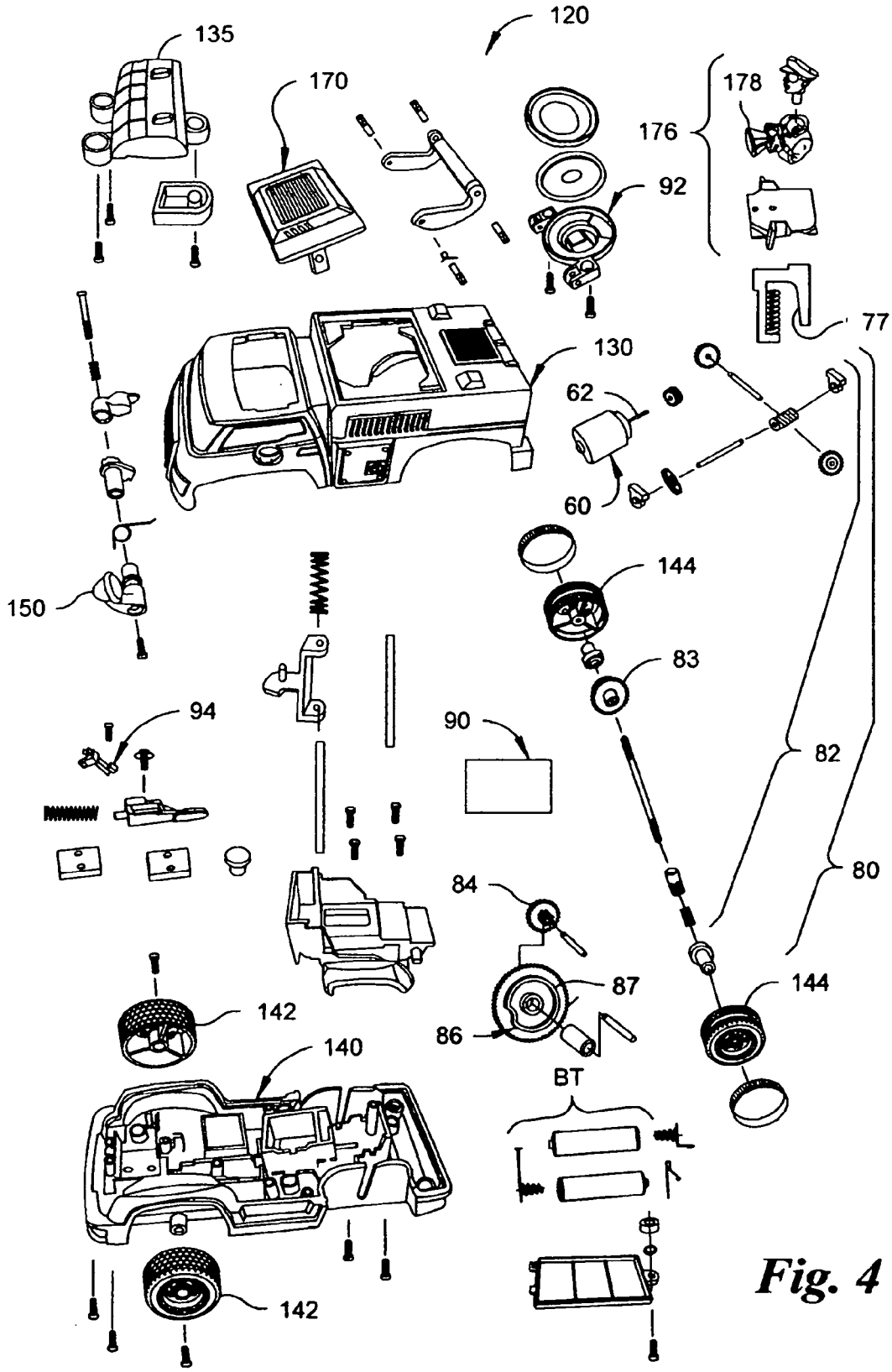
FIG. 4 is an exploded view of the toy vehicle of FIGS. 3A-3B.

In an alternate of the first preferred embodiment shown in FIGS. 3A-3B and 4, a lever activated vehicle 120 includes a body 130, a chassis 140 and a lever 150. The body has a front end 132, a rear end 134, an interior (within the body 130) and an exterior 138. The chassis 140 accommodates the body 130 and has at least a front wheel 142 proximate the front end 132 and a rear wheel 144 proximate the rear end 144. The body 130 and the chassis 140 give the toy vehicle 120 the overall appearance of a police vehicle which includes a flashing light bar 135 on the roof 133. The operation of the lever activated vehicle 120 is substantially the same as the lever activated fire vehicle 20 described in detail above. Of course, the figurine 76 of the fire vehicle 20 has the appearance of a fireman, and here, the figurine has the appearance of a policeman 176 holding a bull horn 178. The moveable part 170 of the lever activated toy vehicle 120 has a first surface 172 visible on the vehicle 120 in at least the concealed position and a second surface 174 visible on the vehicle 120 only in the revealed position. Each of the first and second surfaces 172, 174 has sufficiently different features to differentiate from the other of the first and second surfaces 172, 174.

Figure 5A:
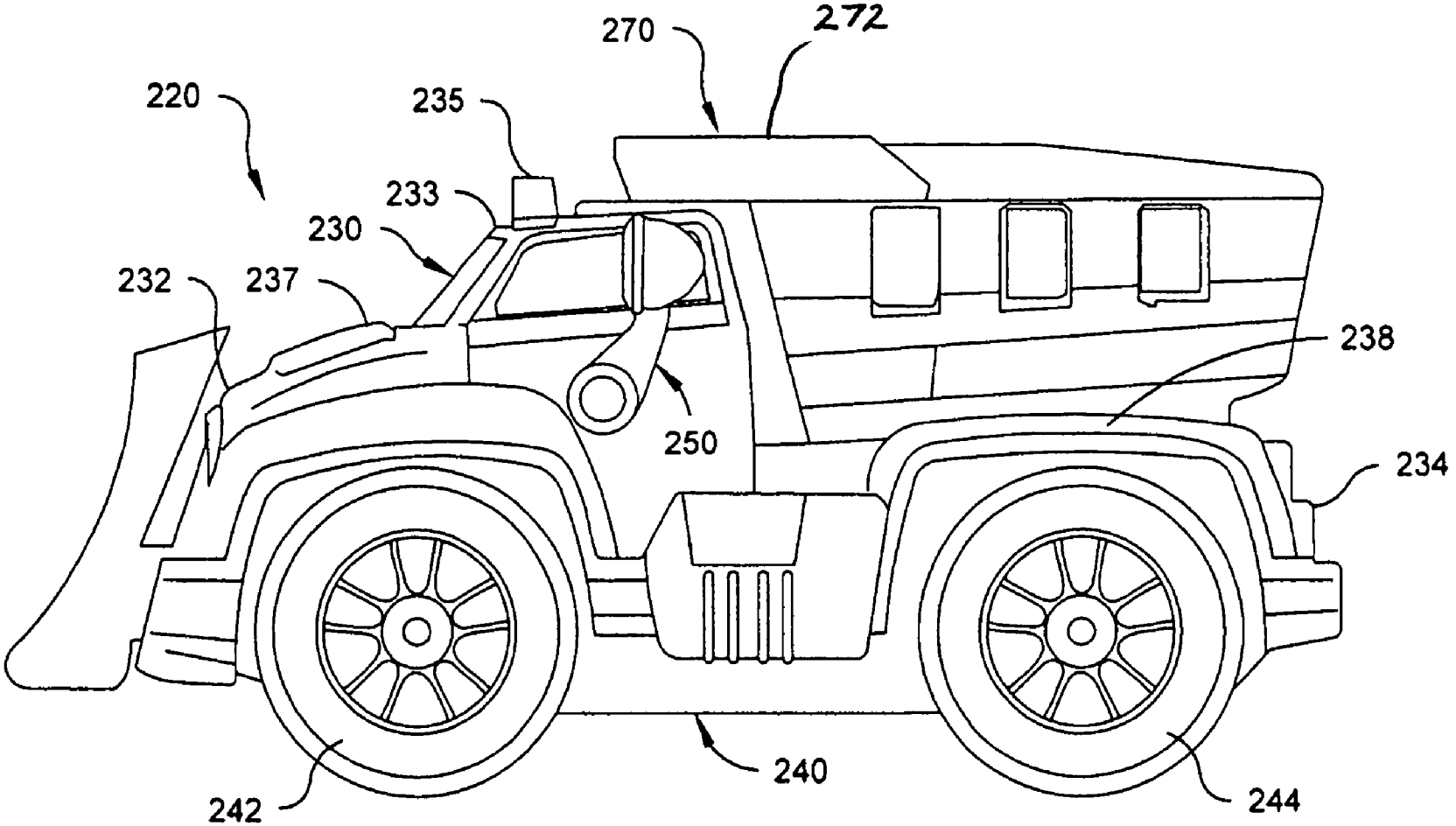
FIG. 5A is a perspective view of another alternate of the first preferred embodiment of FIGS. 1A-1B.
Figure 5B:
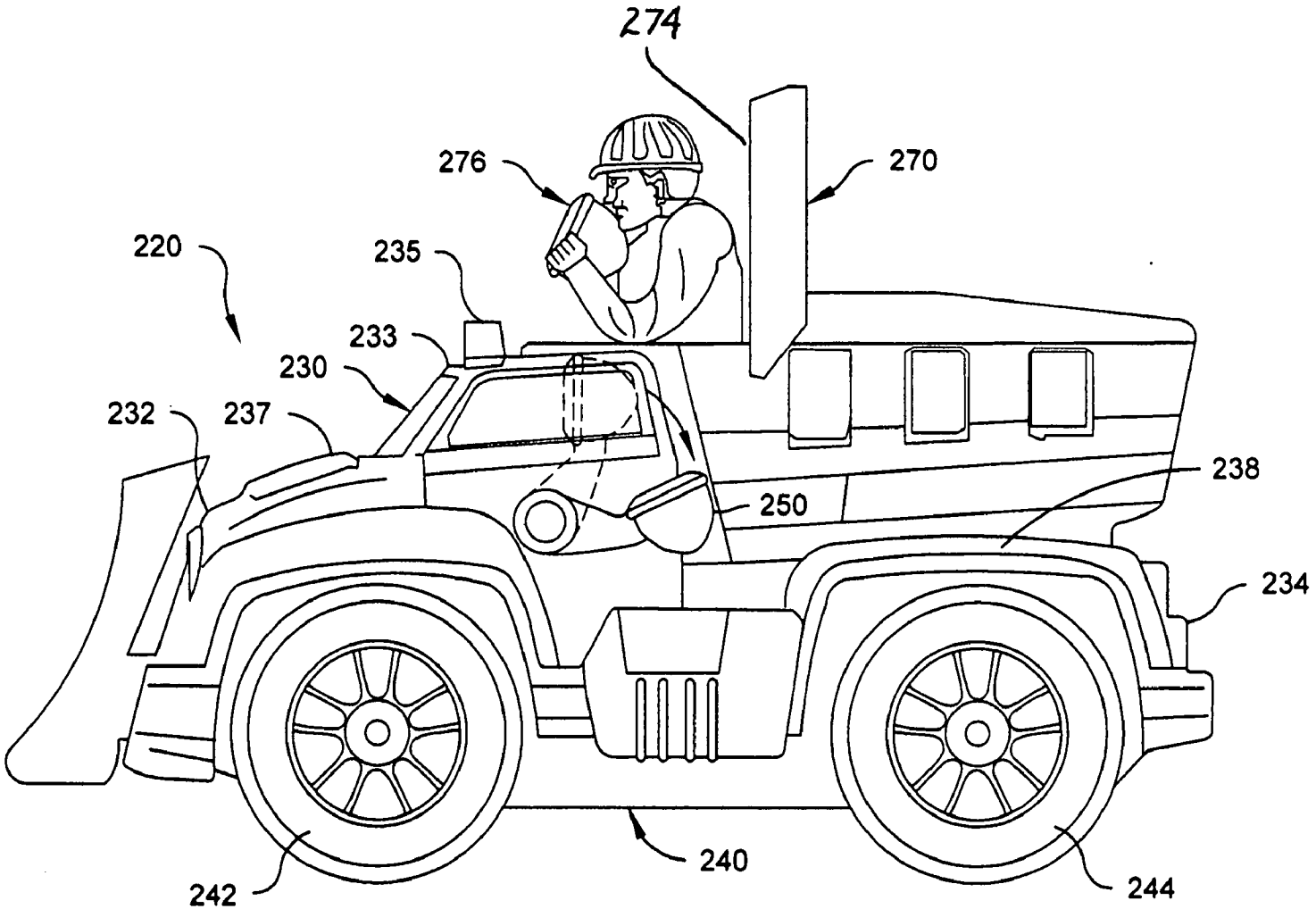
FIG. 5B is a perspective view of the toy vehicle of FIG. 5A in a partially activated position.
Figure 6:
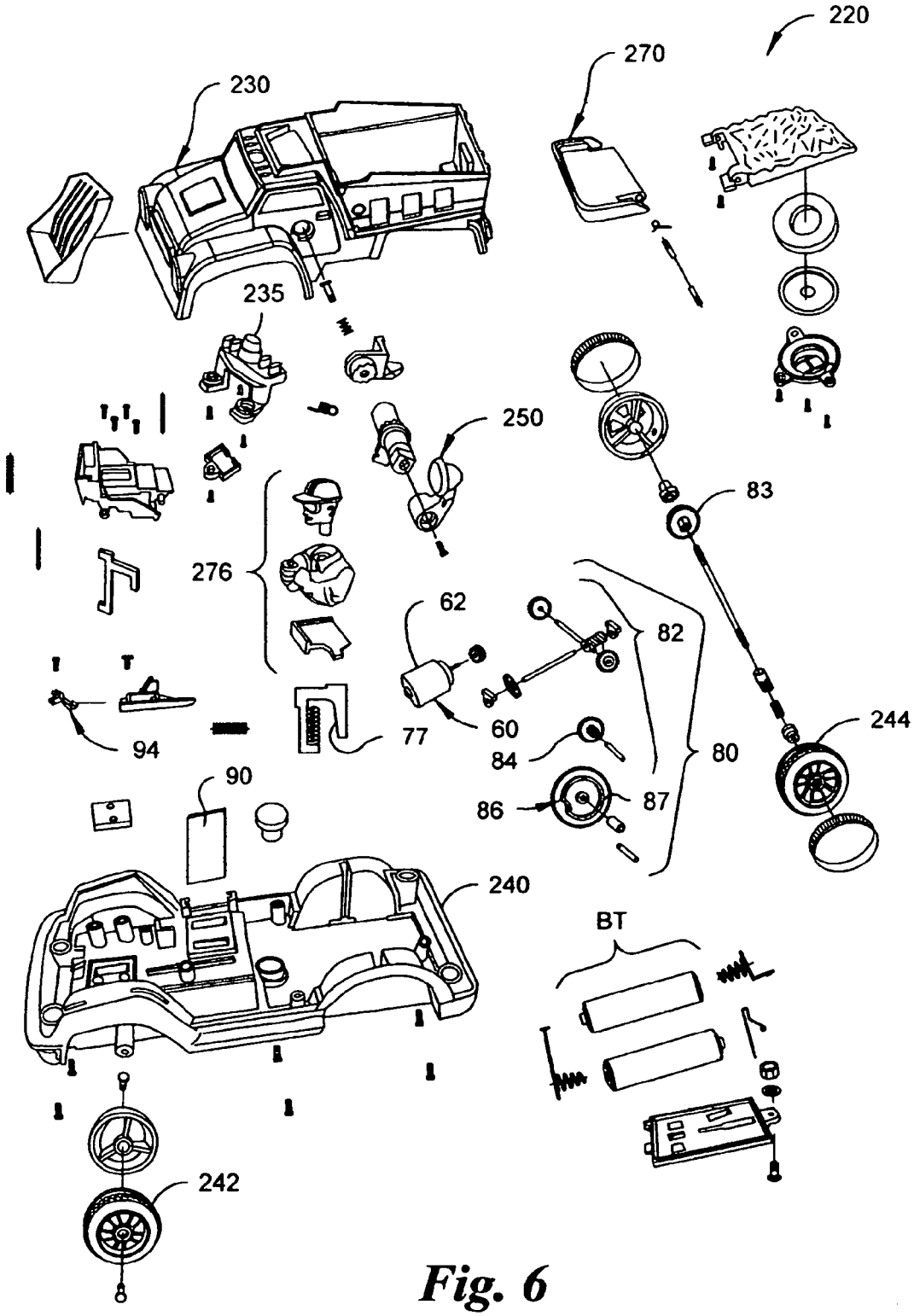
FIG. 6 is an exploded view of the toy vehicle of FIGS. 5A-5B.

In another alternate of the first preferred embodiment shown in FIGS. 5A-5B and 6, a lever activated vehicle 220 includes a body 230, a chassis 240 and a lever 250. The body has a front end 232, a rear end 234, an interior (within the body 230) and an exterior 238. The chassis 240 accommodates the body 230 and has at least a front wheel 242 proximate the front end 232 and a rear wheel 244 proximate the rear end 244. The body 230 and the chassis 240 give the toy vehicle 220 the overall appearance of a construction vehicle which includes a flashing light beacon 235 on the roof 233.

The operation of the lever activated vehicle 220 is substantially the same as the lever activated fire vehicle 20 described in detail above. Of course, the figurine 76 of the fire vehicle 20 has the appearance of a fireman, and here, a figurine 276 has the appearance of a construction worker. The moveable part 270 of the lever activated toy vehicle 220 has a first surface 272 visible on the vehicle 220 in at least the concealed position and a second surface 274 visible on the vehicle 220 only in the revealed position. Each of the first and second surfaces 272, 274 has sufficiently different features to differentiate from the other of the first and second surfaces 272, 274.

Figure 7A:
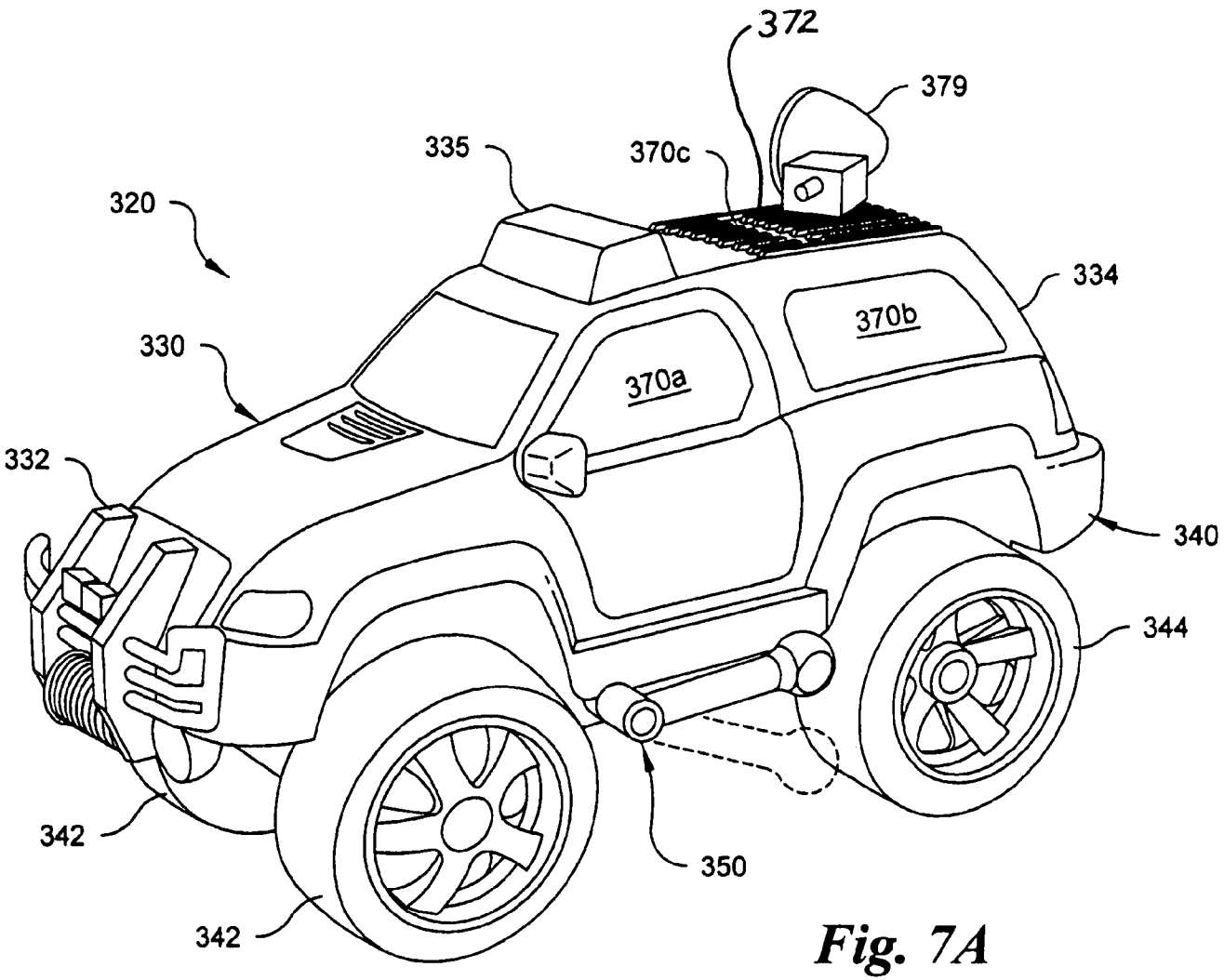
FIG. 7A is a is a perspective view of a second preferred embodiment of a lever activated toy vehicle in accordance with the present invention.
Figure 7B:
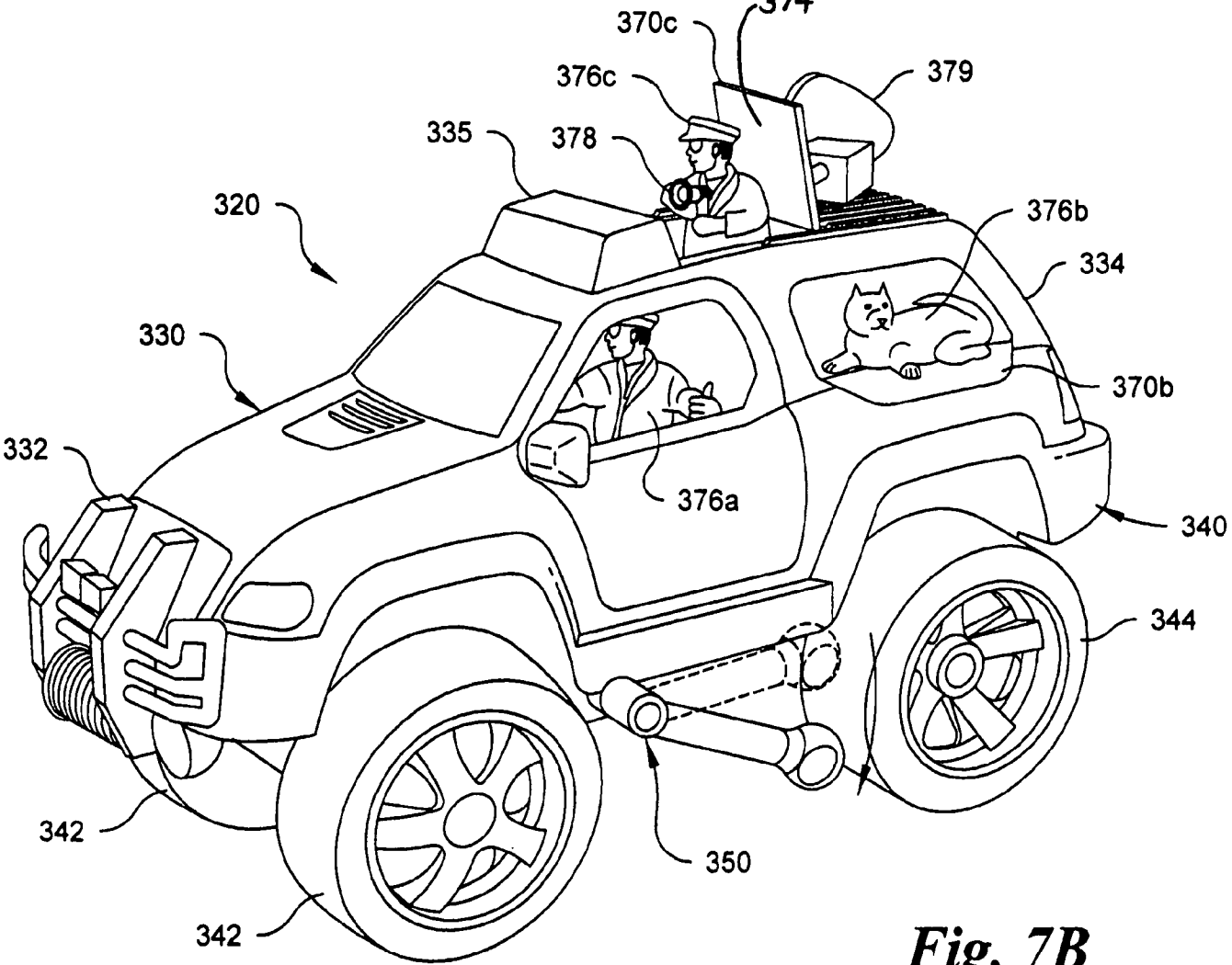
FIG. 7B is a perspective view of the toy vehicle of FIG. 7A in a partially activated position.
Figure 8:
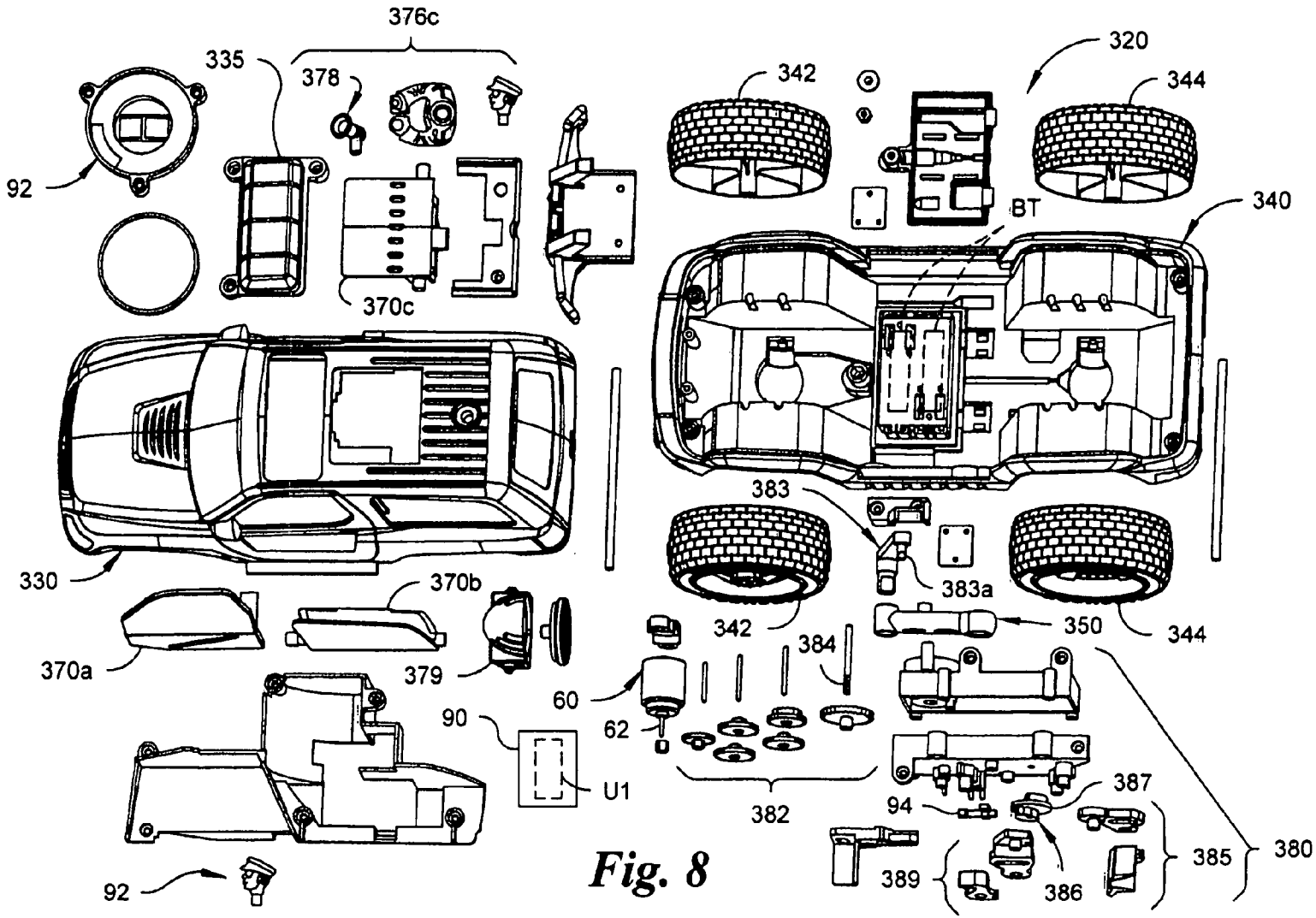
FIG. 8 is an exploded view of the toy vehicle of FIGS. 7A-7B.

FIGS. 7A-7B and 8 show a second preferred embodiment of the present invention which is also a lever activated toy vehicle 320 including a body 330, a chassis 340 and a lever 350. The lever activated toy vehicle 320 of the second preferred embodiment includes many of the attributes and features of the first preferred embodiment. However, the lever activated toy vehicle 320 includes several enhancements such as multiple operational functions and a plurality of moveable parts 370*a*-370*c* concealing a plurality of figurines 376*a*-376*c*, as will be described hereinafter.

In the presently preferred embodiment, the lever 350 has the appearance of a side-pipe exhaust and is disposed beneath a driver-side door 337 of the toy vehicle 320. The toy vehicle 320 further includes a first moveable part 370*a*, a second moveable part 370*b* and a third moveable part 370*c* which are all operably coupled to an actuator mechanism 380 (FIG. 8) similar in concept to the actuator mechanism 80 described above with regards to the first preferred embodiment. In the present case, a gear train 382 includes the at least one power take-off 384 for driving ancillary devices such as a cam 386. The gear train 382 may include the plurality of power take-off devices 384 for driving a plurality of ancillary devices like the cam 386. Here, a single power take-off 384 is configured to drive a plurality of ancillary devices, like the cam 386, a second moveable part lever 389 and a third moveable part lever 385, so that the plurality of moveable parts 370*b*-370*c* can all be moved from a concealed position to a revealed position in concert. However, it is contemplated that there may be a combination of cams 386 each having a unique time-delay in order to move each of the plurality of moveable parts 370*a*-370*b* in a predetermined operational sequence without departing from the present invention.

The first moveable part 370*a* of the lever activated toy vehicle 320 is a "tinted," driver-side door window that is "up" in a concealed position (FIG. 7A) and "down" in a revealed position (FIG. 7B). The first figurine 376*a* is disposed within the body 330 of the vehicle 320 behind the first moveable part 370*a*. Thus, the first figurine 376*a* is hidden from view when the moveable part 370*a* is in the "up" or concealed position (FIG. 7A) and the first figurine 376*a* is viewable when the first moveable part 376*a* is in the "down" or revealed position (FIG. 7B). In the presently preferred embodiment, the lever 350 is directly coupled to a first rotatable arm 383 having a protrusion 383*a* for engagement with a slot 371 in the first moveable part 370*a*. When the lever 350 is moved from a first position to a second position, the first arm 383 correspondingly rotates from a position holding the window 370*a* up to a position holding the window 370*a* down by purely mechanical means. The first figurine 376*a* has the overall appearance of a policeman, or at least the upper torso, arms and head of a policeman. Preferably, the first figurine 376*a* also includes a "bobbing-head" feature.

The second moveable pail 370*b* of the lever activated toy vehicle 320 is a tinted, driver-side rear window that is "up" in a concealed position (FIG. 7A) and "out" in a revealed position (FIG. 7B). The second moveable part 370*b* preferably rotates to the out or revealed position thereby extending outward from the body 330 of the toy vehicle 320. The second figurine 376*b* is disposed within the body 330 of the vehicle 320 behind the second moveable part 370*b*. Thus, the second figurine 376*b* is hidden from view when the moveable part 370*b* is in the "up" or concealed position (FIG. 7A) and the second figurine 376*b* is viewable when the second moveable part 376*b* is in the "down" or revealed position (FIG. 7B). The second figurine 376*b* has the overall appearance of a police dog. Preferably, the second figurine 376*b* is attached to the inner-surface of the second moveable part 370*b* so as to move out from the body 330 of the toy vehicle 320 as the second moveable part 370*b* moves out from the body 330.

The third moveable part 370*c* of the lever activated toy vehicle 320 is a hatch or a portion of a "truck cap" 331 that is hingedly connected to the remaining portion of the truck cap 331. The third figurine 376*c* is disposed within the body 330 of the vehicle 320 beneath the third moveable part 370*c*. Thus, the third figurine 376*c* is hidden from view when the moveable part 370*c* is in the concealed position (FIG. 7A) and the third figurine 376*c* is viewable when the third moveable part 376*c* is in the revealed position (FIG. 7B). Preferably, the figurine 376*c* moves from a withdrawn position to an extended position when the third moveable part 370*c* moves from the concealed position to the revealed position. The third figurine 376*c* has the overall appearance of a policeman, or at least the upper torso, arms and head of a policeman. Additionally, the third figurine 376*c* is speaking into a bullhorn 378. The moveable part 370*c* of the lever activated toy vehicle 320 has a first surface 372 visible on the vehicle 320 in at least the concealed position and a second surface 374 visible on the vehicle 320 only in the revealed position. Each of the first and second surfaces 372, 374 has sufficiently different features to differentiate from the other of the first and second surfaces 372, 374.

The lever activated toy vehicle 320 further includes a control circuit 90 (FIG. 8) having batteries BT similar to the first preferred embodiment. Likewise, the sound generator 92 and the light bar 335 are electrically connected to the control circuit 90. The toy vehicle 320 includes switch 94 that is actuated when the lever 350 is in a second position shown in phantom in FIG. 11. As the user moves the lever 350 from the first position (FIG. 7A) to the second position (FIG. 7B), only the first moveable part 370*a* moves from the concealed position (up) to the revealed position (down). When the lever 350 reaches the second position, the first moveable part 370*a* is in the revealed position, the switch 94 closes allowing power to the motor 60. The motor 60 turns the drive shaft 62 which causes the gear train 82 to turn a cam 386. A primary lobe 387 of the cam 386 thereafter engages the switch for a period to time, so the user can release the lever 350. Once the user releases the lever 350, the lever 350 returns to the first position (FIG. 7A) causing the first arm 383 to move the first moveable part 370*a* to the concealed position as well. The light bar 335 flashes while sound bytes are generated on the sound generator 92. After a predetermined period of time both the second and third moveable parts 370*b*, 370*c* then move from the concealed position to the revealed position. The cam 386 may also include secondary and tertiary lobes 387*b*, 387*c* for driving the second moveable part lever 389 and the third moveable part lever 385 after different periods of time within the predetermined period of time as determined by the primary lobe 387*a*.

Optionally, the gear train 382 drives at least one of the wheels 342, 344 causing the toy vehicle 320 to move generally forward. In either scenario, after performance of the operation, the moveable parts 370*b*-370*c* move back from the revealed position to the concealed position.

Further, the lever activated toy vehicle 320 of the second preferred embodiment includes a rotating searchlight or spotlight 379 mounted on the body 330 of the toy vehicle 320. Preferably, the spotlight 379 is not mechanized for automatic operation, but obviously the spotlight 379 could be mechanized and moveable without departing from the present invention.

Figure 9A:
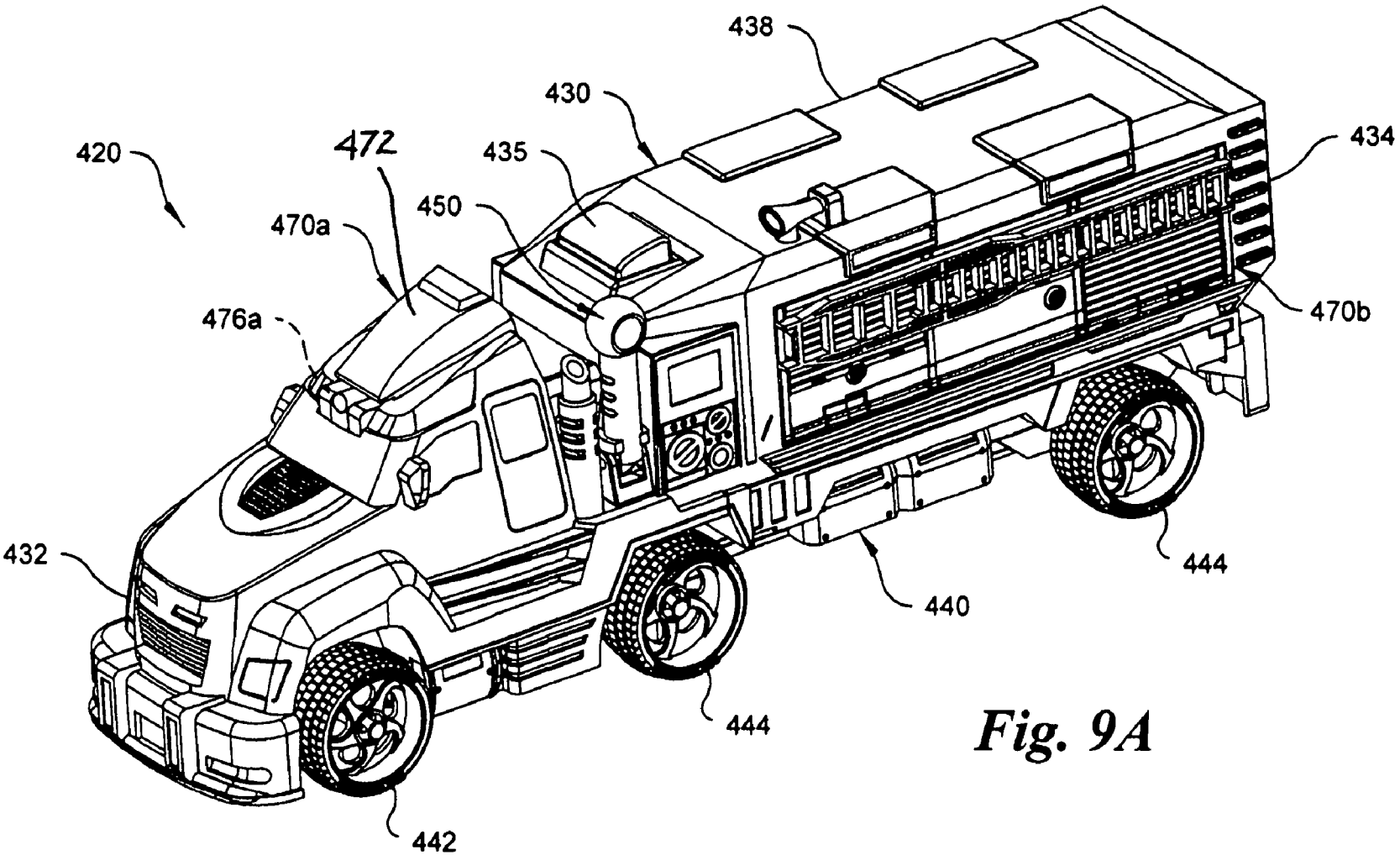
FIG. 9A is a perspective view of a third preferred embodiment of a lever activated toy vehicle in accordance with the present invention.
Figure 9B:
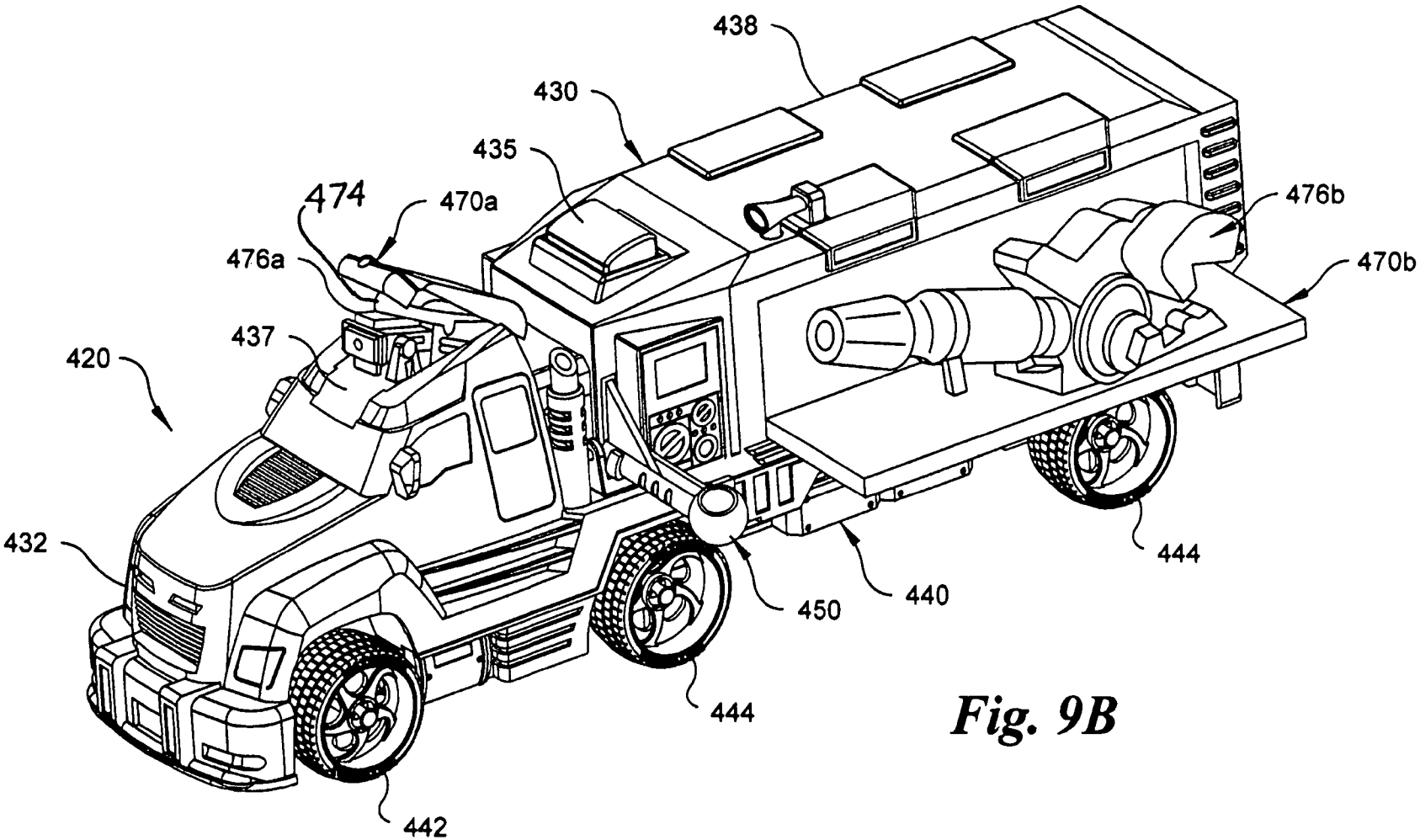
FIG. 9B is a perspective view of the toy vehicle of FIG. 9A in a partially activated position.
Figure 10:
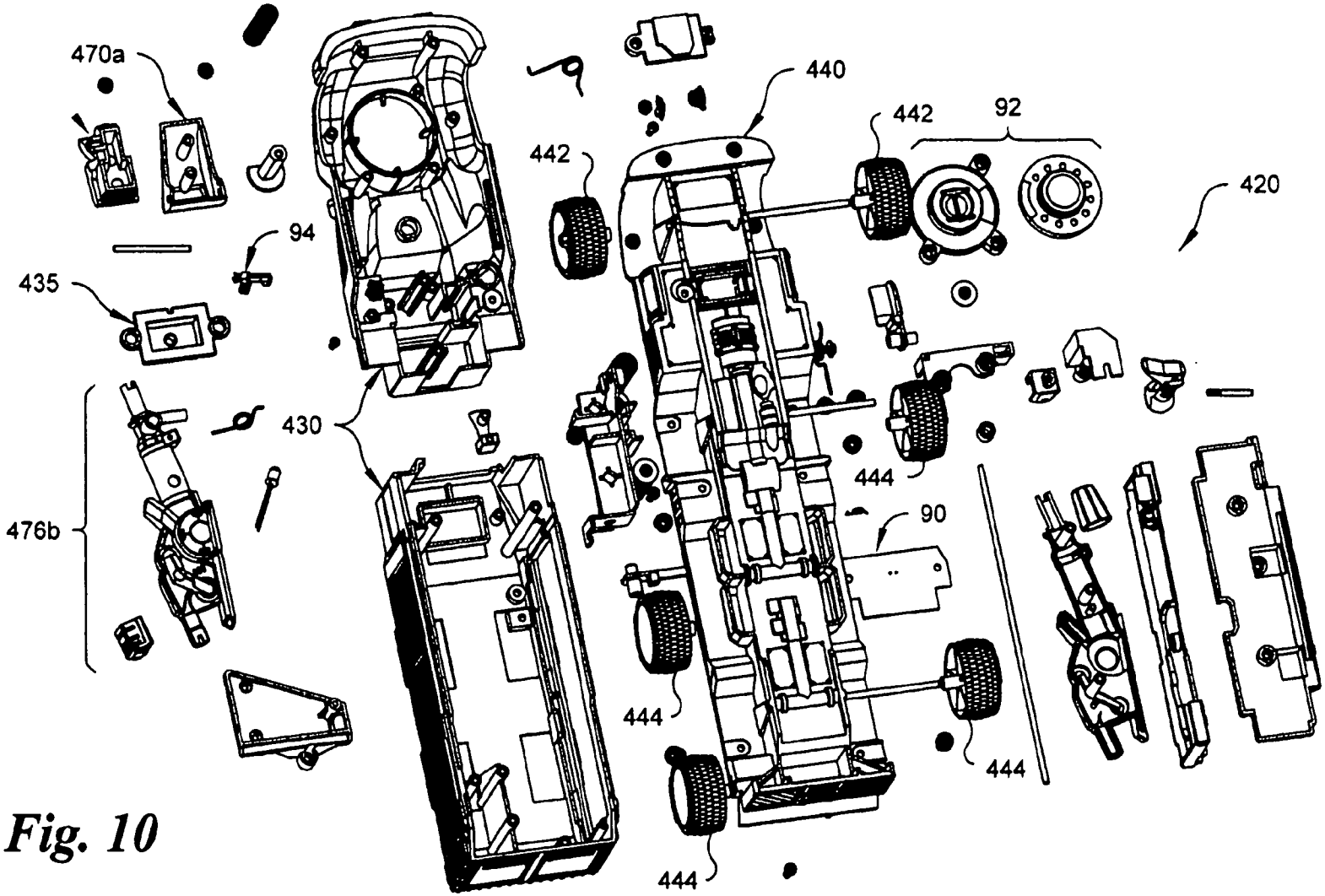
FIG. 10 is an exploded view of the toy vehicle of FIGS. 9A-9B.

FIGS. 9A-9B and 10 show a third preferred embodiment of the present invention which is also a lever activated toy vehicle 420 including a body 430, a chassis 440 and a lever 450. The body 430 has a front end 432, a rear end 434, an interior 437 and an exterior 438. The chassis 440 accommodates the body 430 and has at least a front wheel 442 proximate the front end 432 and a rear wheel 444 proximate the rear end 434. Preferably, the toy vehicle 420 includes two front wheels 442 and two sets of two rear wheels 444 staggered like a tractor trailer. The lever 450 is movably supported on one of the chassis 440 and the body 430 of the toy vehicle 420 so as to be accessible by a user for movement between a first or upright position (FIG. 9A) and a second or down position (FIG. 9B).

The toy vehicle 420 further includes a moveable part 470*a*, an actuator mechanism 482 and a moveable accessory 470*b*. The moveable part 470*a* has at least a portion on the exterior 438 of the body 430 and a portion on the interior 437 of the body 430. The moveable part 470*a* is supported on at least one of the chassis 440 and the body 430 for movement between a concealed position and a revealed position. The moveable part 470*a* of the lever activated toy vehicle 420 has a first surface 472 visible on the vehicle 420 in at least the concealed position and a second surface 474 visible on the vehicle 420 only in the revealed position. Each of the first and second surfaces 472, 474 has sufficiently different features to differentiate from the other of the first and second surfaces 472, 474. The actuator mechanism 482 is operably coupled with the lever 450 and the moveable part 470*a*. The actuator mechanism 482 is configured to move the moveable part from the concealed position to the revealed position by mechanical translation after the lever 450 is moved from the first position to the second position and is configured to move the moveable part from the revealed position back to the concealed position thereafter. The moveable accessory 470*b* is operably coupled with one of the lever 450 and the actuator mechanism 482. The moveable accessory 470*b* is supported on at least one of the chassis 440 and the body 430 for movement between a stored position and an operated position.

Figure 17:
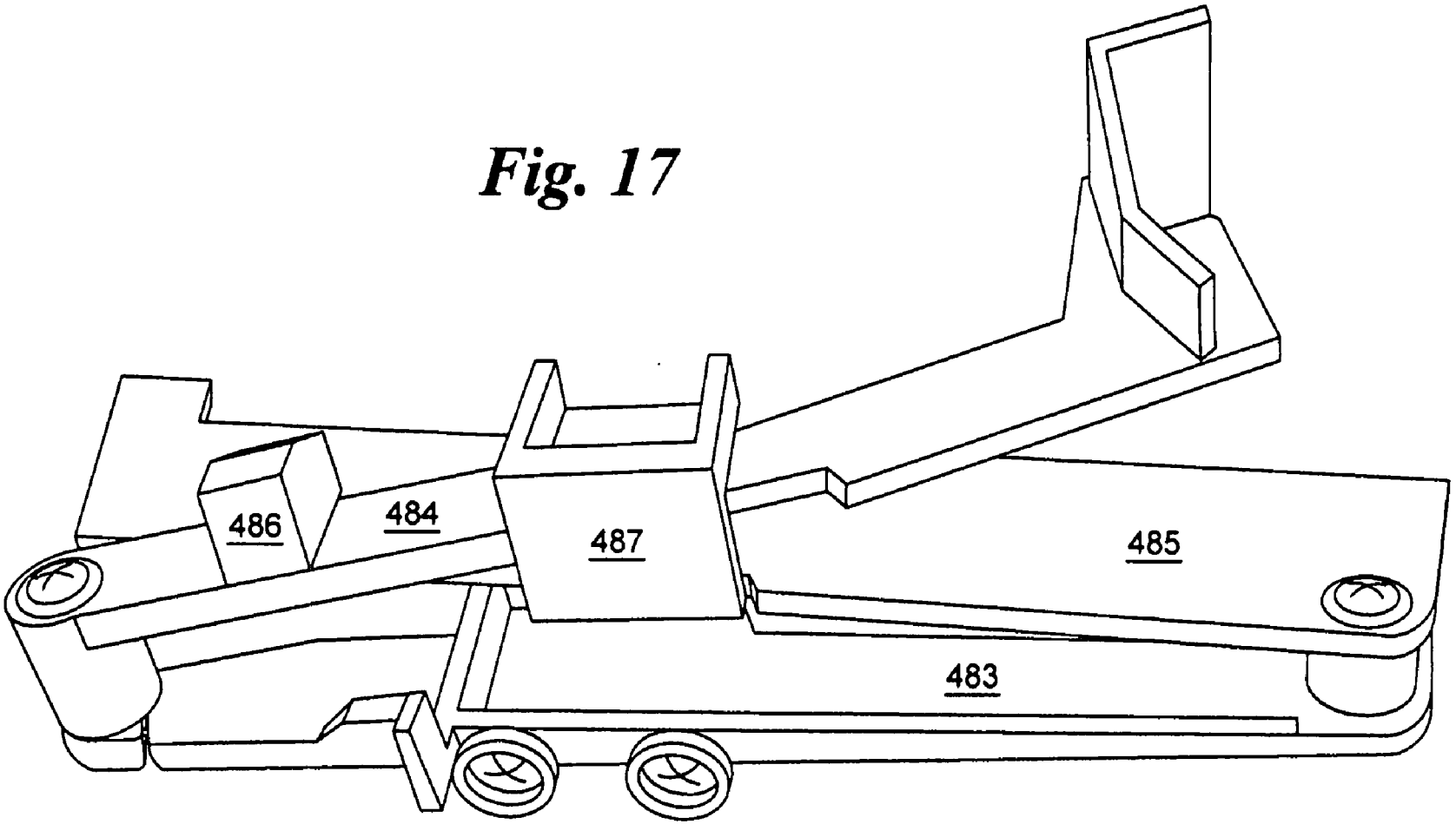
FIG. 17 is an enlarged detail of an actuator mechanism of the toy vehicle of FIGS. 9A and 9B.

In the presently preferred embodiment, the actuator mechanism 482 is completely mechanically operated through forces provided by the user moving the lever 450 from the first position to the second position. The lever activated toy vehicle 450 completely lacks a motor, and is therefore a free-wheeling vehicle. Actuator mechanism 482 and its components are shown in FIG. 17. The actuator mechanism 482 includes a base 483, a rearwardly extending arm 484, a forwardly extending arm 485 and an activation ramp 486. The base 483 is rigidly mounted within the body 430 of the toy vehicle 420. The rearwardly extending arm 484 is rotatably mounted to the forwardmost end of the base 483 and the forwardly extending arm 485 is rotatably mounted to the rearmost end of the base 483 such that the two arms 484, 485 cross (not shown clearly). A finger 487 is positioned under the two arms 484, 485 proximate the region where the arms 484, 485 cross. The finger 487 is coupled to the lever 450 such that when the lever 450 is pulled down, the finger 487 causes the arms 484, 485 to raise into an X-like configuration similar to a scissor or accordion lift mechanism. As the rearwardly extending arm 484 is raised, it pushes up on the second moveable part 470*b* causing the second moveable part 470*b* to rotate out. The second moveable part 470*b* is spring biased so as to return to the concealed position when the rearwardly extending arm is lowered. Likewise, when the forwardly extending arm 485 is raised, it pushes up on the first moveable part 470*a* causing the first moveable part 470*a* to move from the concealed position to the revealed position. The first moveable part 470*a* is also spring biased so as to move back to the concealed position when the forwardly extending arm 485 is lowered. Further, when the rearwardly extending arm 484 is raised, the activation ramp 486 closes the switch 94.

The toy vehicle 420 does include a control circuit 90 (FIG. 10) having a battery or batteries (not shown) mounted within at least one of the body 430 and the chassis 440, which is very similar to the control circuits 90 described above. The lever activated toy vehicle 420 also includes a sound generator 92 electrically connected to the control circuit 90. The light bar 435 is also electrically connected to the control circuit 90. When the switch 94 is closed, the batteries BT provide power to the control circuit 90. The control circuit 90 energizes the light bar 435 causing it to illuminate or flash and simultaneously drives the sound generator 92 by playing sound bytes, music, sirens, horns and the like.

In use, a user moves the lever 450 from the first position (FIG. 9A) to the second position (FIG. 9B) thereby causing the mechanical actuator mechanism 482 to cause the moveable part 470*a* to move from the concealed position to the revealed position and simultaneously a water gun turret 476*a* pops-up from underneath the moveable part 470*a*. Simultaneously, the moveable accessory 470*b* rotates approximately 90 degrees upon actuation of the lever 450, i.e., a door 470*b* rotates open from the side of the vehicle 420, thereby revealing a water gun or cannon 476*b*. When the lever 450 reaches the second position, the switch 94 is closed thereby causing the control circuit 90 to energize the light bar 435 and generate sound bytes on the sound generator 92. Release of the lever 450 causes the pop-up gun turret 476*a* to retract and the moveable part 470*a* to simultaneously move back to the concealed position. Simultaneously, the moveable accessory 470*b* rotates back up to the stored position. Release of the lever 450 can also cause the light bar 435 and sound effects to cease, although, alternatively, they can be set to cease upon expiration of a predetermined period of time.

Figure 11A:
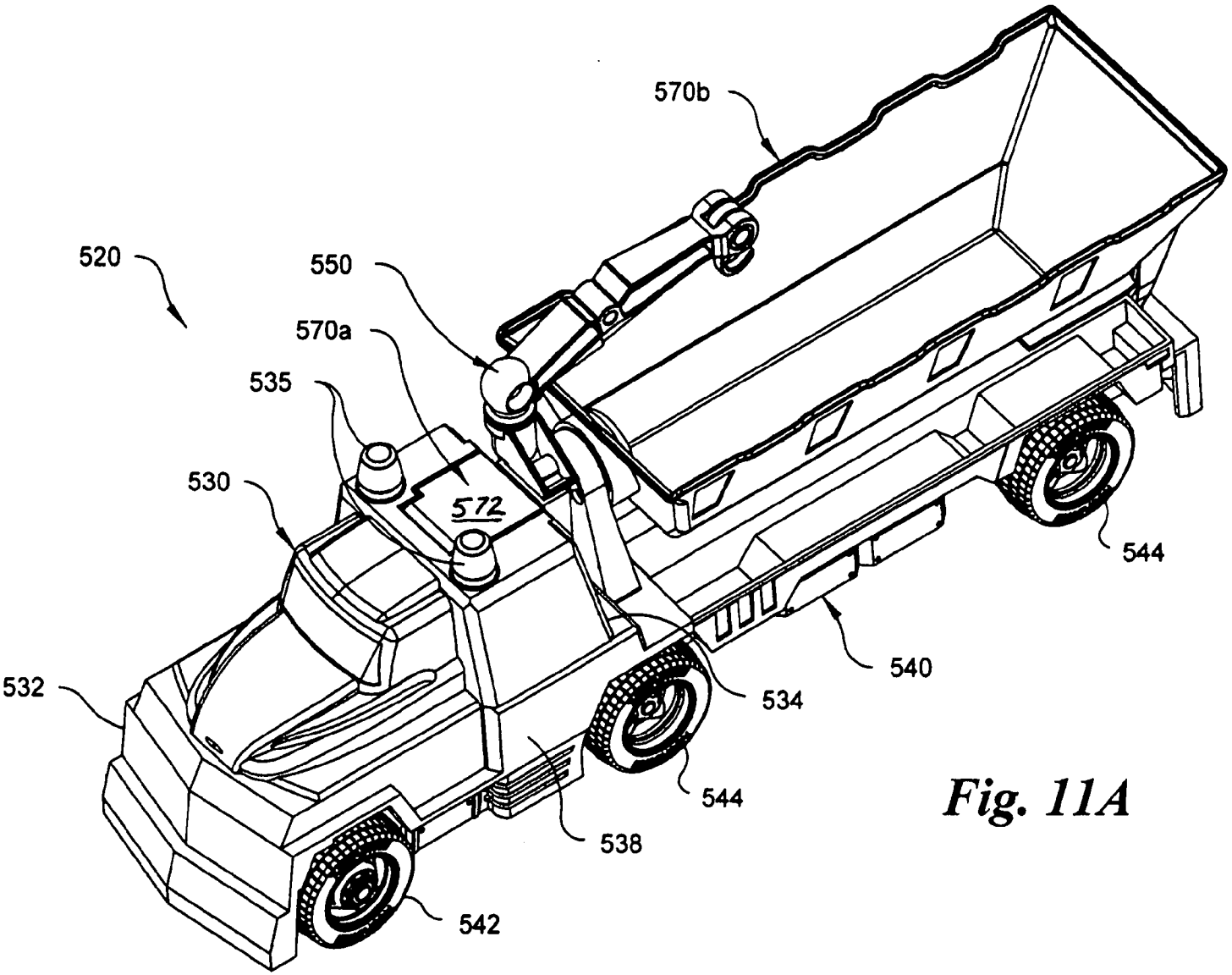
FIG. 11A is a perspective view of an alternate of the third preferred embodiment of FIGS. 9A-9B.
Figure 11B:
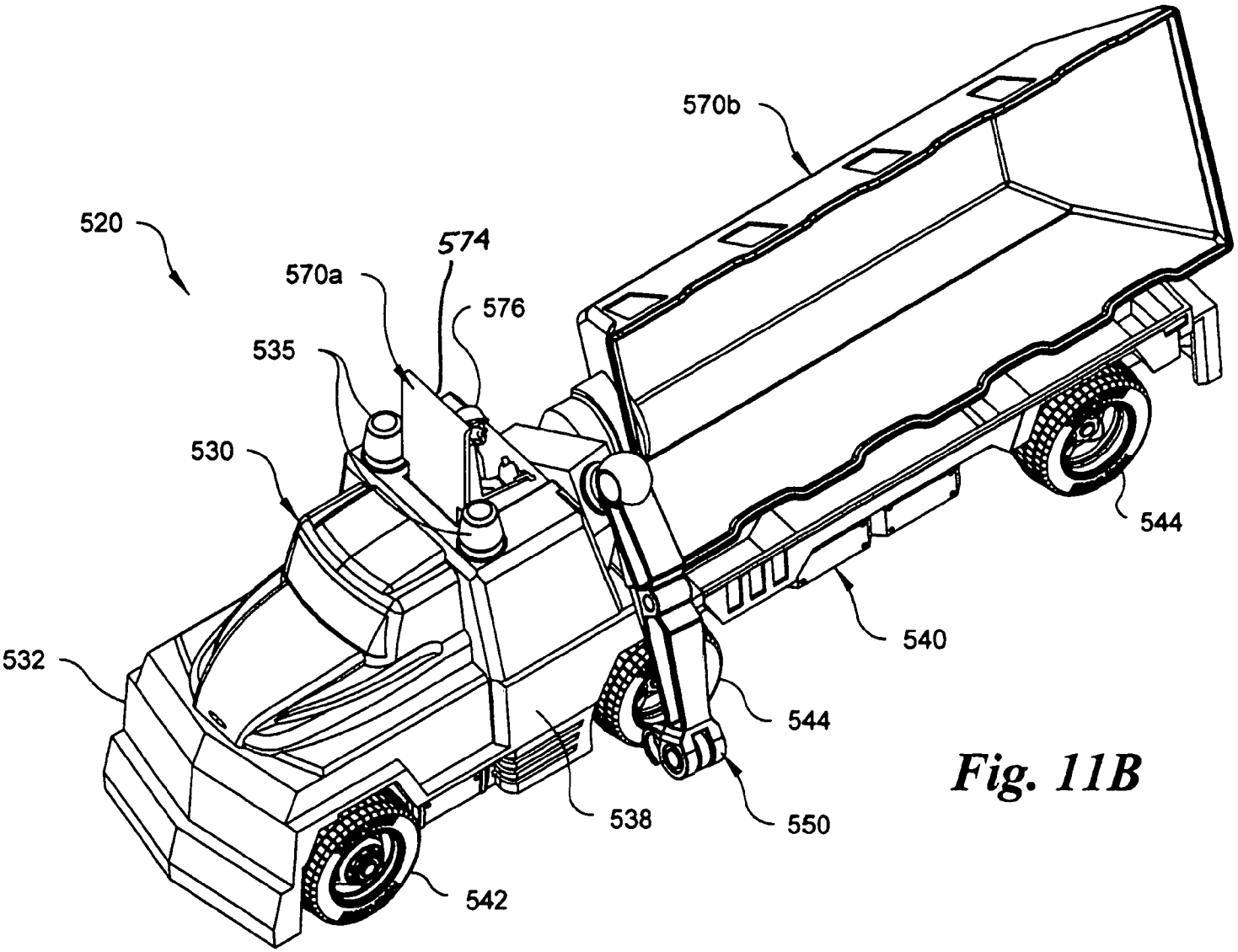
FIG. 11B is a perspective view of the toy vehicle of FIG. 11A in a partially activated position.
Figure 12:
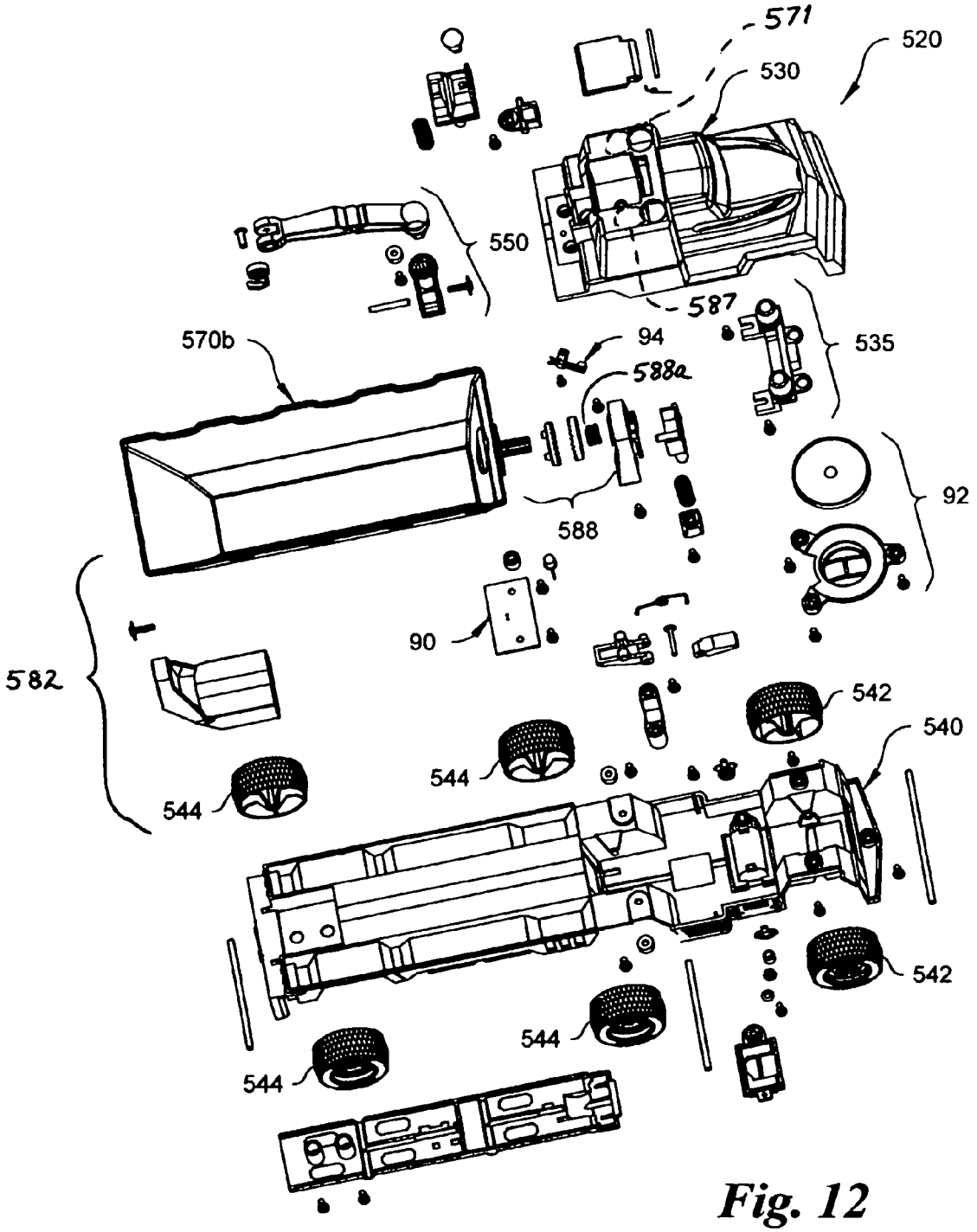
FIG. 12 is an exploded view of the toy vehicle of FIGS. 11A-11B.

An alternate of the third preferred embodiment is shown in FIGS. 11A-11B and 12 including a lever activated toy vehicle 520, a body 530, a chassis 540 and a lever 550. The body 530 has a front end 532, a rear end 534, an interior 537 and an exterior 538. The chassis 540 accommodates the body 530 and includes two front wheels 542 and two sets of two rear wheels 544 staggered like a tractor trailer. The lever 550 is movably supported on one of the chassis 540 and the body 530 of the toy vehicle 520 so as to be accessible by a user for movement between a first or upright position (FIG. 11A) and a second or down position (FIG. 11B). In the presently preferred embodiment, the lever 550 has the overall appearance of a boom and is disposed directly aft of the cab 539 of the vehicle 520.

The toy vehicle 520 further includes a moveable part 570*a*, an actuator mechanism 582 (FIG. 18) and a moveable accessory 570*b*. The moveable part 570*a* has at least a portion on the exterior 538 of the body 530 and a portion on the interior 537 of the body 530. The moveable part 570*a* is supported on at least one of the chassis 540 and the body 530 for movement between a concealed position and a revealed position. The actuator mechanism 582 is operably coupled with the lever 550 and the moveable part 570*a*. The moveable part 570*a* of the lever activated toy vehicle 520 has a first surface 572 visible on the vehicle 520 in at least the concealed position and a second surface 574 visible on the vehicle 520 only in the revealed position. Each of the first and second surfaces 572, 574 has sufficiently different features to differentiate from the other of the first and second surfaces 572, 574. The actuator mechanism 582 is configured to move the moveable part 570*a* from the concealed position to the revealed position by mechanical translation after the lever 550 is moved from the first position to the second position and is configured to move the moveable part from the revealed position back to the concealed position thereafter. The moveable accessory 570*b* is operably coupled with one of the lever 550 and the actuator mechanism 582. The moveable accessory 570*b* is supported on at least one of the chassis 540 and the body 530 for movement between a stored position and an operated position. In the present embodiment, the toy vehicle 520 has the overall appearance of a construction vehicle and the moveable accessory 570*b* has the overall appearance of a dump bed. Similar to the third preferred embodiment, the actuator mechanism 582 is purely mechanical. Here, the rotation feature of the moveable accessory 570*b* rotates approximately 90 degrees upon actuation of the lever 550, i.e. the bucket 570*b* of the construction type lever activated vehicle 520 tipping to the side. Further, the moveable part 570*a* reveals a pop-up construction worker figurine 576 when the moveable part moves to the revealed position.

Figure 18:
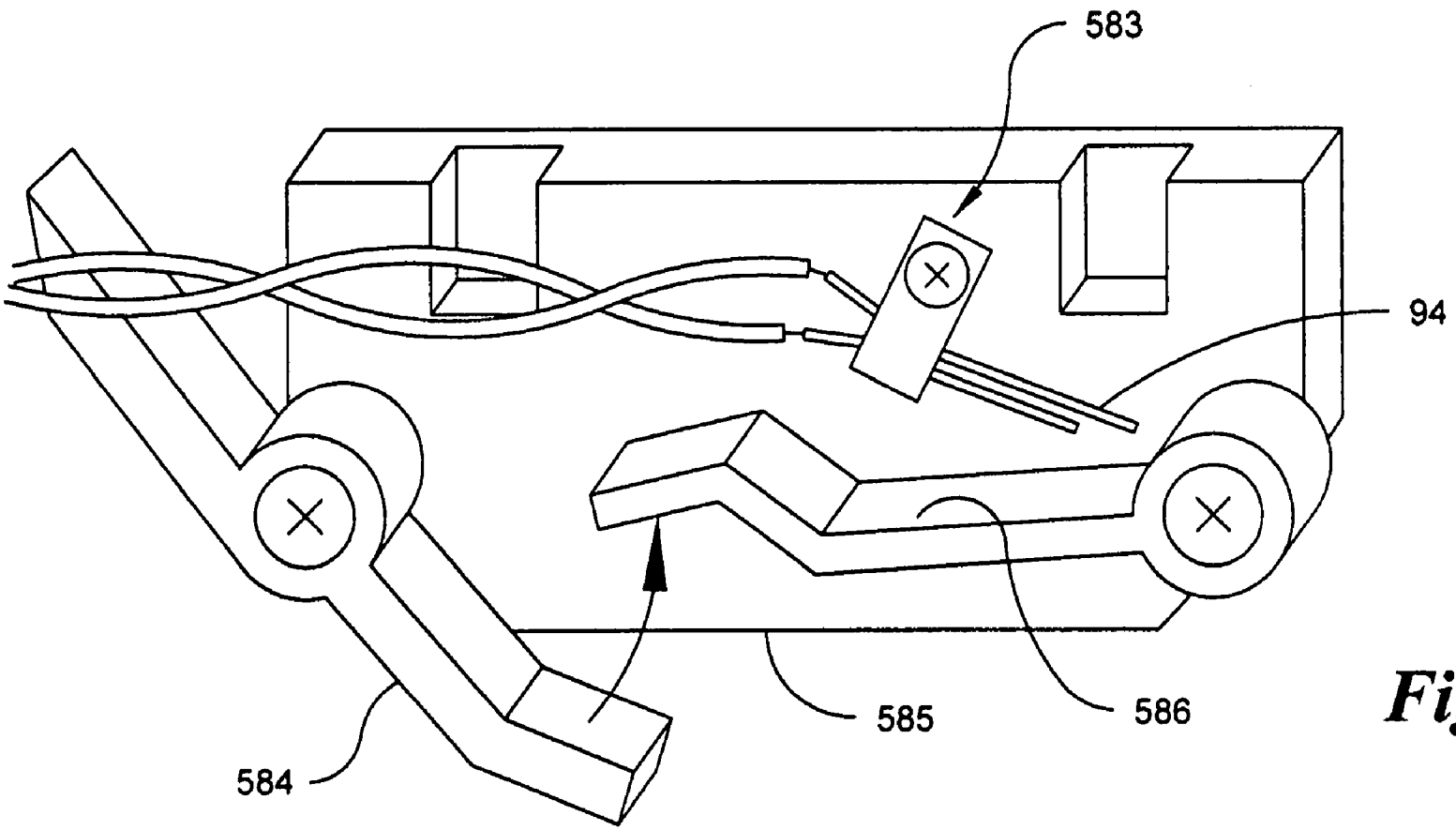
FIG. 18 is an enlarged detail of an actuator mechanism of the toy vehicle of FIGS. 11A and 11B.

Referring to FIG. 18 in detail, the activator mechanism 582 includes a base 583, a first arm 584, a second arm 585 with an activation ramp portion 586. The activation ramp portion 586 is an attached or integrally formed protrusion of the second arm 585. The first arm 584 is pinned to the base 583 in order to rotatably move toward the ramp 586 which, in turn, causes the second arm 585 to raise. An actuator plunger 587 is coupled to the lever 550 so that when the lever 550 is pushed down the actuator plunger 587 pushes down on the first arm 584. As the first arm 584 is pushed down, one end contacts and moves the second arm 585 correspondingly up thereby pushing on a moveable part plunger 571 causing the first moveable part 570*a* to move from the concealed position to the revealed position. The moveable part plunger 571 is spring biased so as to return to the concealed position as the second arm 585 is lowered (i.e., when the lever 550 is released). As the first moveable arm 584 pushes up on the activation ramp 586, the activation ramp 586 pushes the switch 94 to a closed position. The actuator mechanism 582 further includes a spring loaded clutch 588 is coupled between the lever 550 and the second moveable part 570*b* such that when the lever 550 is moved from the first position to the second position, the clutch 588 correspondingly moves the bucket 570*b* in a rotary fashion unless there is excessive resistance which is enough to overcome a clutch spring 588*a*.

Figure 13A:
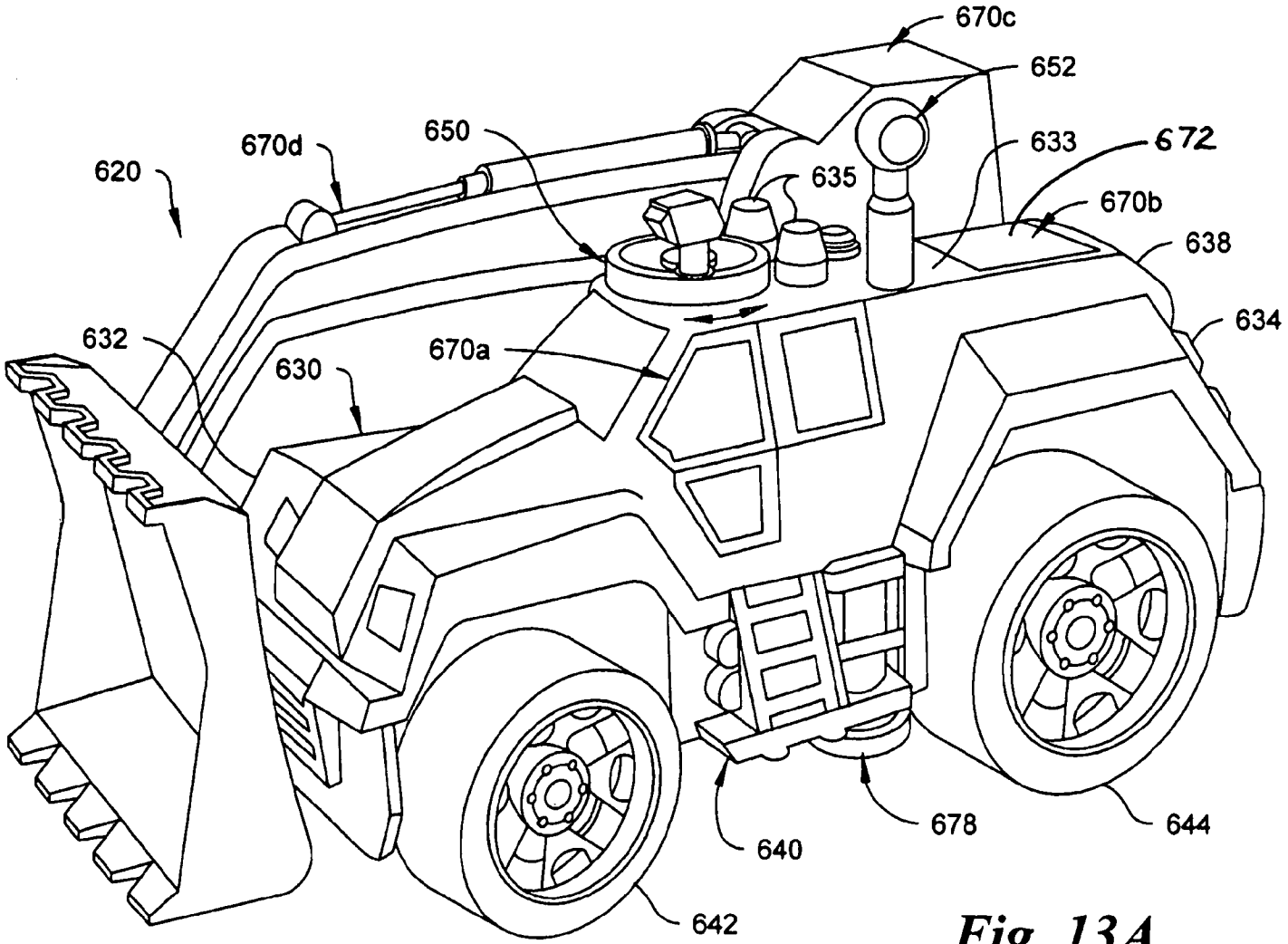
FIG. 13A is a perspective view of a fourth preferred embodiment of a wheel activated toy vehicle in accordance with the present invention.
Figure 13B:
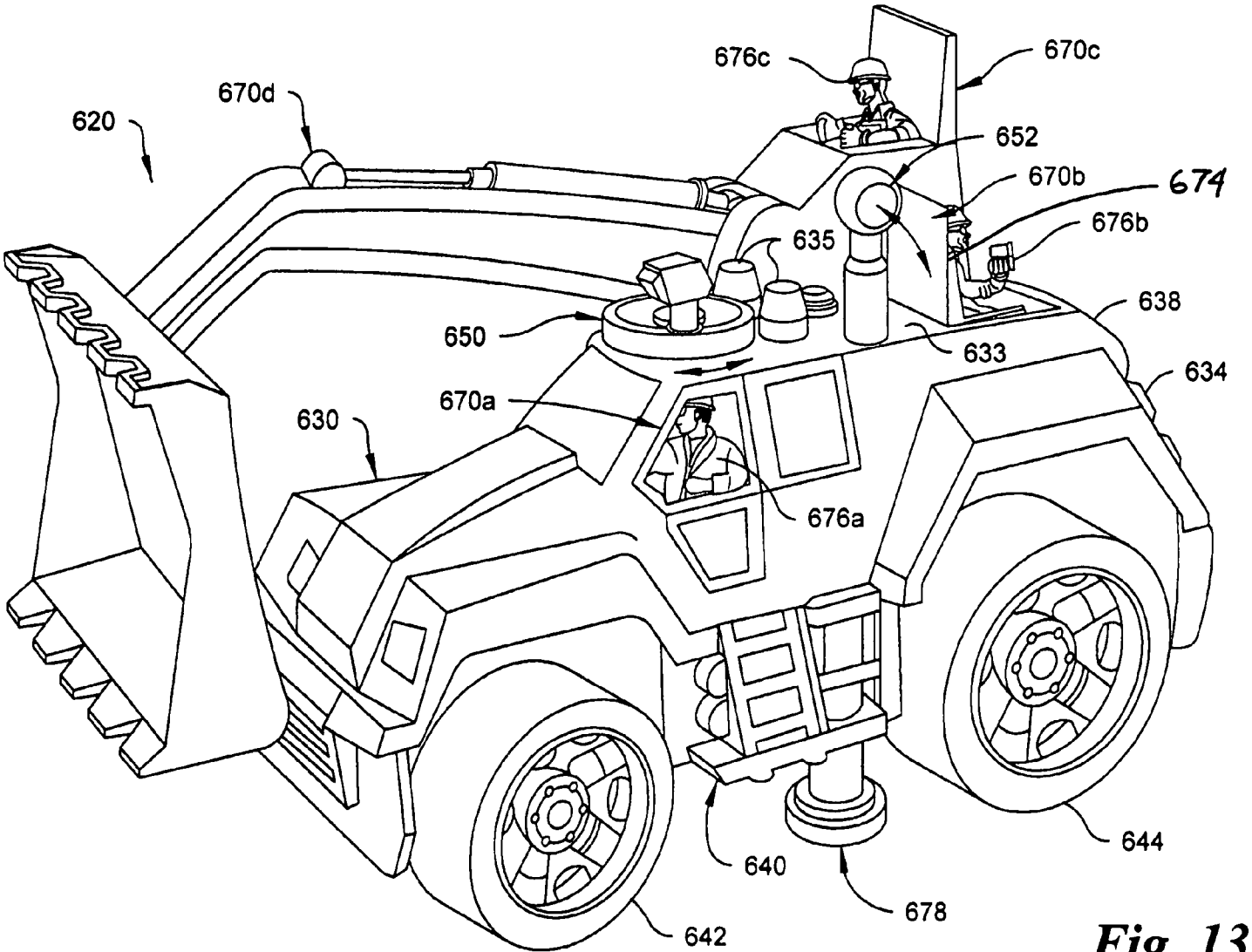
FIG. 13B is a perspective view of the toy vehicle of FIG. 13A in a partially activated position.
Figure 14:
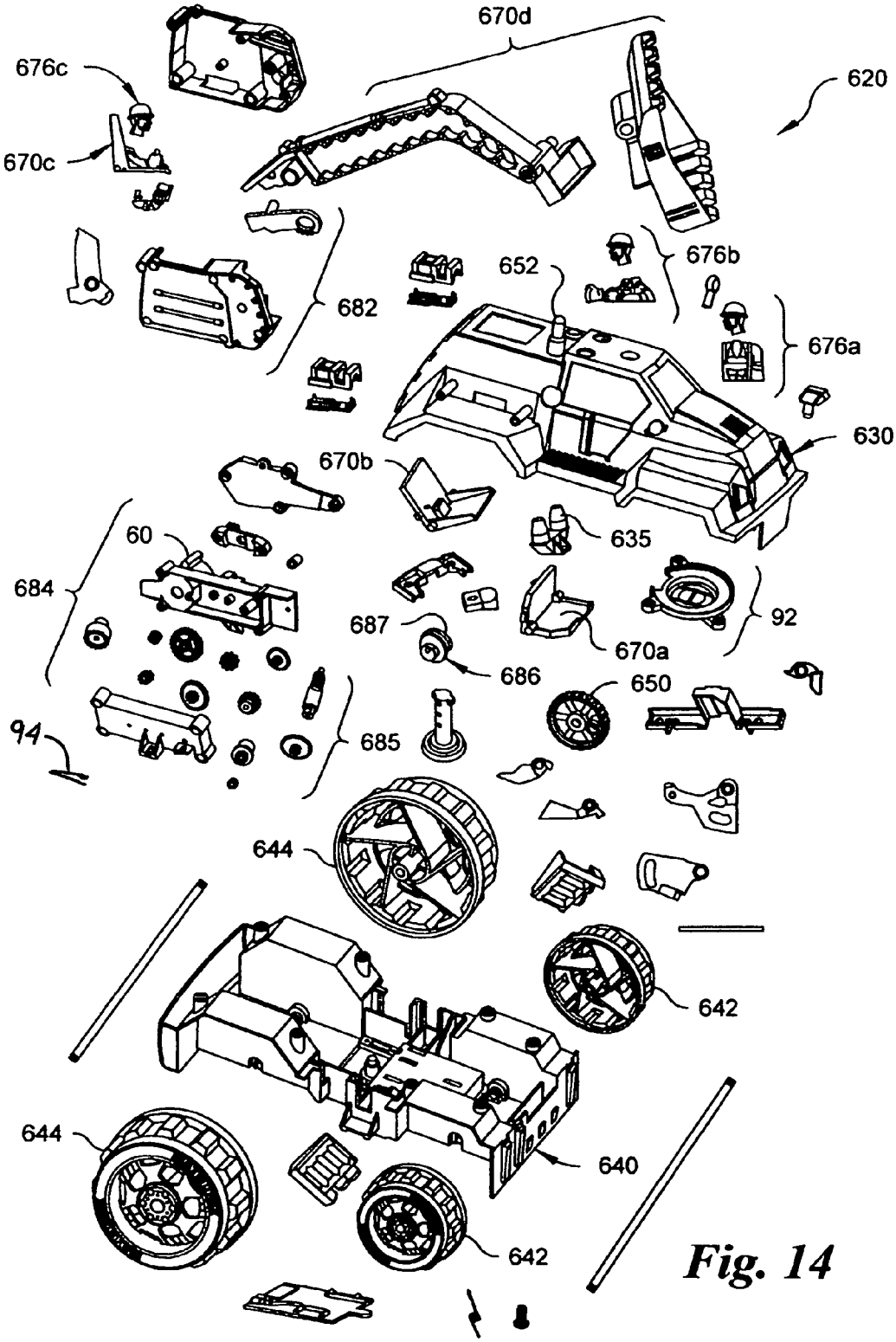
FIG. 14 is an exploded view of the toy vehicle of FIGS. 13A-13B.

FIGS. 13A-13B and 14 show a fourth preferred embodiment of the present invention including a wheel activated toy vehicle 620. The wheel activated toy vehicle 620 including a body 630, a chassis 640, a crank wheel 650 and a pushbutton 652. The body 630 has a front end 632, a rear end 634, an interior (not shown clearly) and an exterior 638. The chassis 640 accommodates the body 630 and has at least a front wheel 642 proximate the front end 632 and a rear wheel 644 proximate the rear end 634. Preferably, the toy vehicle 620 includes two front wheels 642 and two rear wheels 644. Preferably, the toy vehicle 620 has the overall appearance of a construction vehicle. The crank wheel 650 is movably supported on one of the chassis 640 and the body 630 of the toy vehicle 620 so as to be accessible by a user for rotational movement between a first position where the crank wheel 650 bottoms out on a down travel-stop (not shown) and a second position where the crank wheel 650 tops out on an up travel-stop (not shown). Each of the travel-stops may be defined by merely limiting the length of the thread, or alternatively, by having physical protruding abutments which limit travel.

The toy vehicle 620 further includes a first moveable part 670*a*, a second moveable part 670*b*, a third moveable part 670*c*, a first actuator mechanism 682, a second actuator mechanism 684 and a moveable accessory 670*d*. The first actuator mechanism 682 is operably coupled with the crank wheel 650, the third moveable part 670*c* and the moveable accessory 670*d*, and the second actuator mechanism 684 us operably coupled with the first and second moveable parts 670*a*-670*b*. The first actuator mechanism 682 is completely mechanically operated through forces provided by the user rotating the crank wheel 650 from the first position to the second position. The first actuator mechanism 682 is configured to move the third moveable part 670*c* from its concealed position to its revealed position by mechanical translation as the crank wheel 650 is rotated from the first position to the second position and is configured to move the third moveable part 670*c* from its respective revealed position back to its concealed position as the crank wheel 650 is rotated in the opposite direction from the second position to the first position. The moveable accessory 670*d* is supported on at least one of the chassis 640 and the body 630 (in this case, the body 630) for movement between a stored position (FIG. 13A) and an operated position (FIG. 13B).

The second actuator mechanism 684 is operably coupled with the first and second moveable parts 670*a*-670*b* and is configured to move the moveable parts 670*a*-670*b* from their respective concealed positions to their revealed positions. In particular, the second actuator mechanism 684 is configured to move the first and second moveable parts 670*a*-670*b* from their concealed positions to their revealed positions and is configured to move the first and second moveable parts 670*a*-670*b* from their revealed positions back to their concealed positions after a predetermined time has elapsed. The moveable part 670*b* of the toy vehicle 620 has a first surface 672 visible on the vehicle 620 in at least the concealed position and a second surface 674 visible on the vehicle 620 only in the revealed position. Each of the first and second surfaces 672, 674 has sufficiently different features to differentiate from the other of the first and second surfaces 672, 674.

The second actuator mechanism 684 comprises a gear train 685 which is in mesh with a shaft (not shown) of the motor 60. Preferably, the predetermined time is based upon a mechanical cam 686 operably coupled to the second actuator mechanism 684. When the user operates one of the rotary crank wheel 650 or the pushbutton 652, the switch 94 is closed and the motor 60 begins to operate thereby causing the mechanical cam 686 to rotate and maintain the switch 94. When the mechanical cam 686 rotates past its time lobe 687, the switch 94 is not longer maintained and power is removed from the motor 60.

The toy vehicle 620 also includes a pair of manually extendable outriggers 678 which can be directly manipulated by a user from a raised position (FIG. 13A) to a lowered position (FIG. 13B).

The wheel activated toy vehicle 620 includes the motor 60, but the toy vehicle 620 is a free-wheeling vehicle. The motor 60 is for operation of the first and second moveable parts 670*a* and 670*b*. The toy vehicle 620 also includes a control circuit 90 (FIG. 14) having a battery or batteries BT mounted within at least one of the body 630 and the chassis 640, which is very similar to the control circuits 90 described above. The crank wheel 650 operates a rotary actuated switch 94 (i.e., switch contacts are the same as any switch 94, but are actuate by a rotational mechanism such as a cam or protrusion) when the crank wheel 650 is moved off the down travel-stop by a predetermined amount. Alternatively or additionally, the pushbutton 652 can actuate the switch 94. The wheel activated toy vehicle 620 also includes a sound generator 92 electrically connected to the control circuit 90. Light beacons 635 are also electrically connected to the control circuit 90. When the switch 94 is closed, the batteries BT provide power to the control circuit 90. The control circuit 90 energizes the light beacons 635 causing them to illuminate or flash and simultaneously drives the sound generator 92 by playing sound bytes, music, horns and the like.

The first moveable part 670*a* is a driver-side window which moves from an "up" or concealed position to a "down" or revealed position. Behind the first moveable part 670*a* is a first construction worker figurine 676*a* which is revealed when the first moveable part 670*a* is in the revealed position, i.e., when the window is "rolled down." The second and third moveable parts 670*b*, 670*c* are hatches on a roof 633 of the toy vehicle 620. Underneath the second moveable part 670*b* is a second pop-up construction worker figurine 676*b* holding a pair of binoculars and looking in a rearward direction. Underneath the third moveable part 670*c* is a third pop-up construction worker figurine 676*c* which appears to be operating controls for the moveable accessory 670*d*. The moveable accessory 670*d* has the overall appearance of a bucket on a boom. The moveable accessory 670*d* moves from a lowered position (FIG. 13A) to a raised position (FIG. 13B) in relation to corresponding rotation of the crank wheel 650 by a user.

In use, a user rotates the crank wheel 650 from the first position (the down travel-stop) to the second position (the up travel-stop) thereby causing the first mechanical actuator mechanism 682 to cause the third moveable part 670*c* to move from the concealed position to the revealed position. When the crank wheel 650 comes off the down travel-stop by the predetermined amount, the rotary actuated switch 94 is closed thereby causing the control circuit 90 to energize the light beacons 635 and generate sound bytes on the sound generator 92. The second actuator mechanism 684 causes the first construction worker figurine 676*a* to be revealed from behind the first moveable part 670*a*, and the second worker figurine 676*b* to pop-up from underneath the second moveable part 670*b*. Simultaneously, the moveable accessory 670*d* rotates approximately 30-45 degrees in correspondence with rotation of the crank wheel 650. Multiple turns (full rotations) of the crank wheel 650 may be required to cause the moveable accessory 670*d* to move from the lowered position to the raised position. Rotating the crank wheel 650 in the opposite direction causes third figurine 676*c* to retract and the third moveable part 670*c* to move back to the concealed position. Simultaneously, the moveable accessory 670*d* rotates back down to the lowered position. When the crank wheel 650 reaches the down travel-stop, the switch 94 is no longer closed so the light beacons 635 and sound effects cease, although, alternatively, they can be set to cease upon expiration of a predetermined period of time by using a storage capacitor or by maintaining the switch 94 by the lobe of a cam as described in the embodiments above.

Figure 15A:
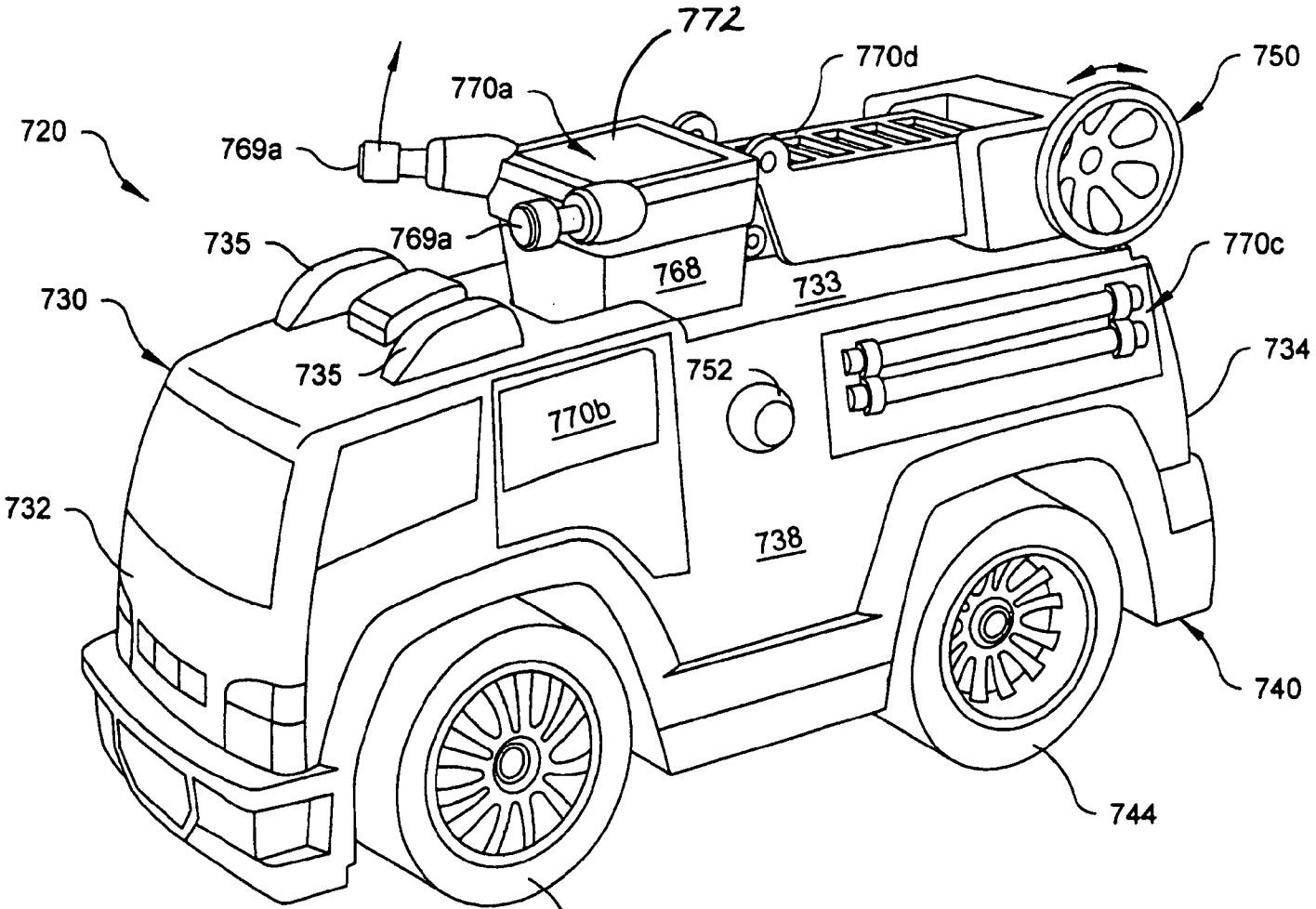
FIG. 15A is a perspective view of an alternate of the fourth preferred embodiment of FIGS. 13A-13B.
Figure 15B:
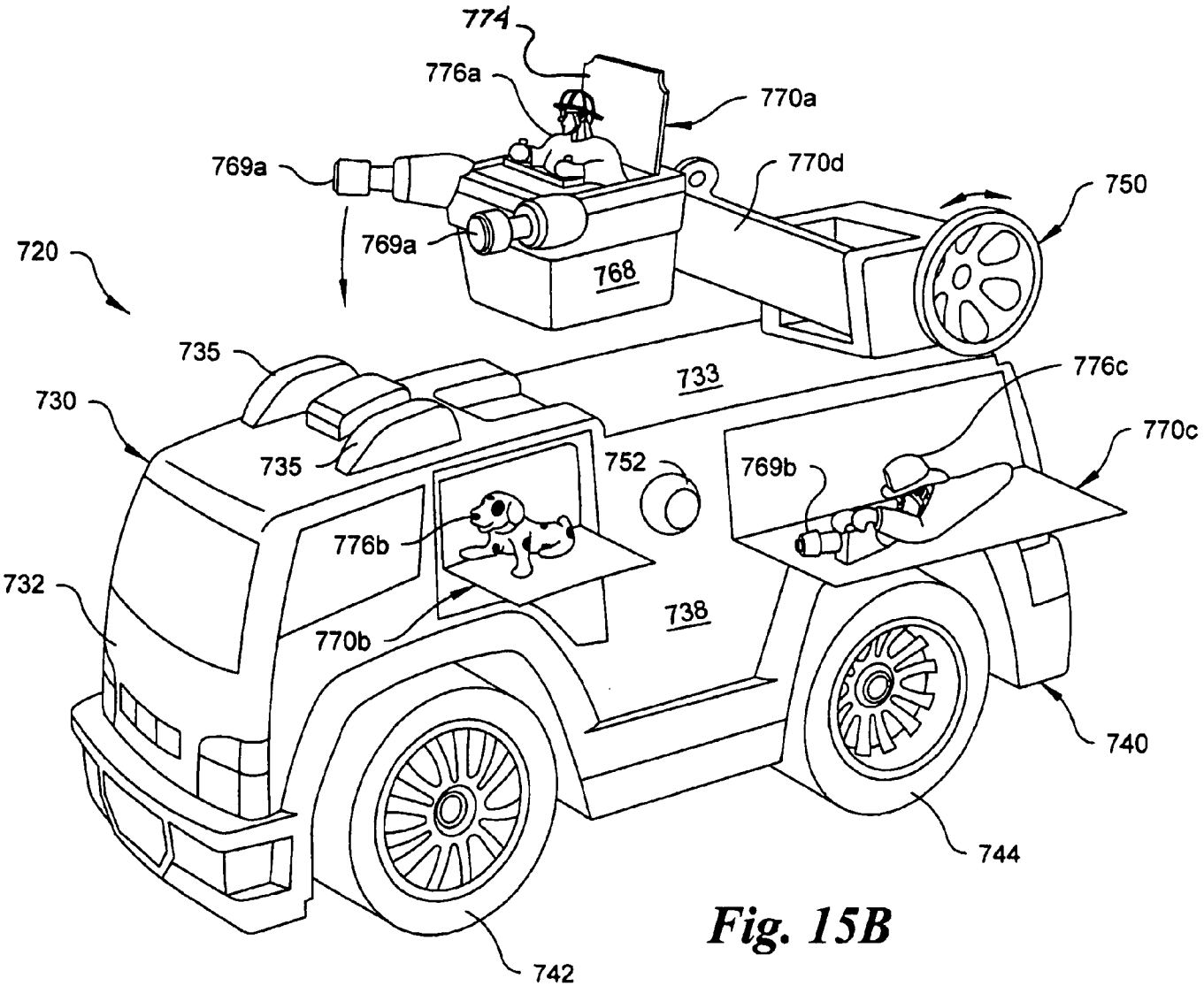
FIG. 15B is a perspective view of the toy vehicle of FIG. 15A in a partially activated position.
Figure 16:
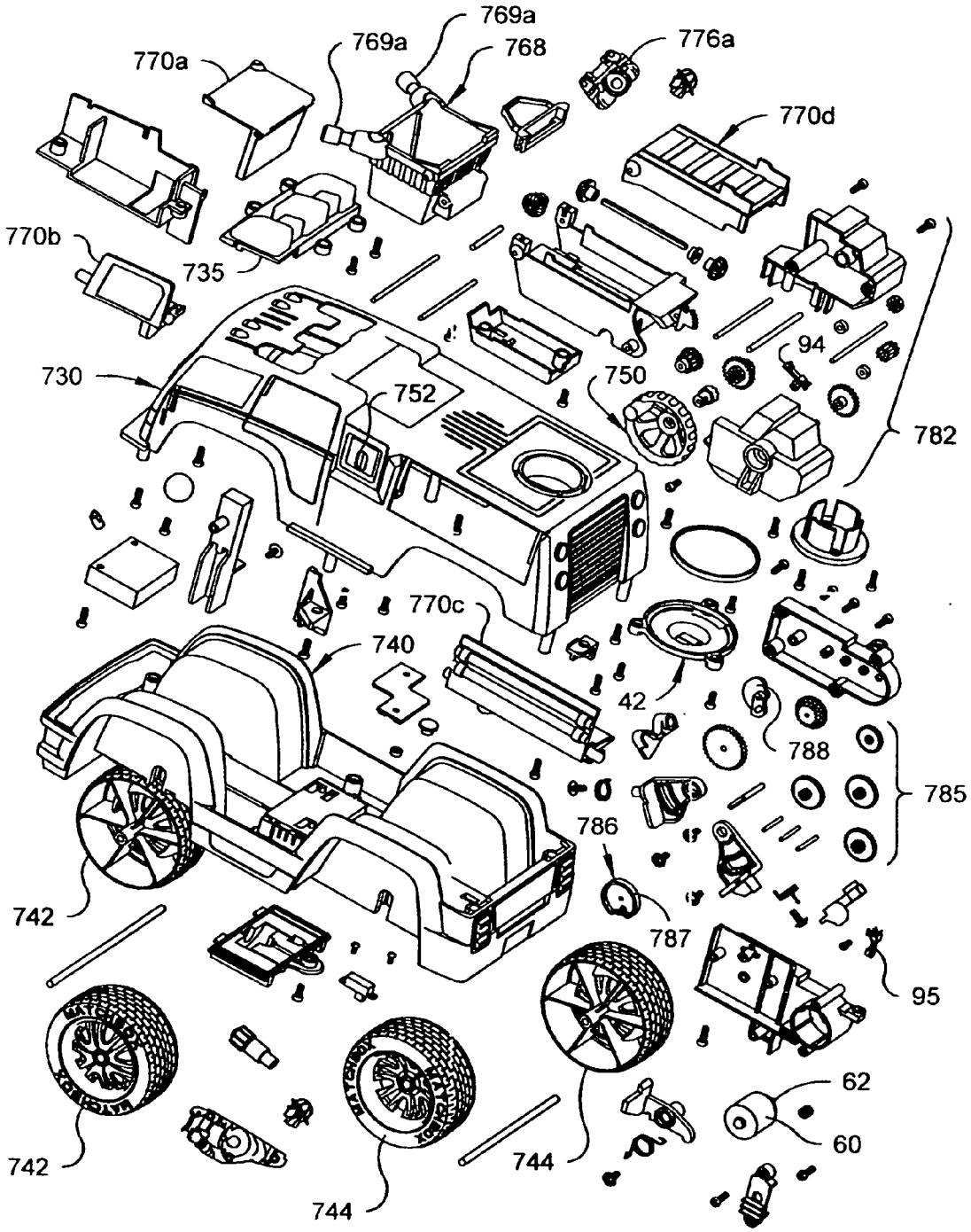
FIG. 16 is an exploded view of the toy vehicle of FIGS. 15A-15B.

An alternate of the fourth preferred embodiment is shown in FIGS. 15A-15B and 16 including a wheel activated toy vehicle 720. The wheel activated toy vehicle 720 includes a body 730, a chassis 740 and a crank wheel 750. The body 730 has a front end 732, a rear end 734, an interior 737 and an exterior 738. The chassis 740 accommodates the body 730 and has two front wheels 742 and two rear wheels 744. Preferably, the toy vehicle 720 has the overall appearance of a fire ladder truck. The crank wheel 750 is movably supported on one of the chassis 740 and the body 730 of the toy vehicle 720 so as to be accessible by a user for rotational movement between a first position where the crank wheel 750 bottoms out on a down travel-stop (not shown) and a second position where the crank wheel 750 tops out on an up travel-stop (not shown). Each of the travel-stops may be defined by merely limiting the length of the thread, or alternatively, by having physical protruding abutments which limit travel.

The toy vehicle 720 further includes a first moveable part 770*a*, a second moveable part 770*b*, a third moveable part 770*c*, a first actuator mechanism 782, a second actuator mechanism 784 and a moveable accessory 770*d*. The first actuator mechanism 782 is operably coupled with the crank wheel 750, the first moveable part 770*a* and the moveable accessory 770*d*. The first actuator mechanism 782 is configured to move the moveable part 770*a* from its concealed position (FIG. 15A) to its revealed position (FIG. 15B) by mechanical translation as the crank wheel 750 is rotated from the first position to the second position and is configured to move the moveable part 770*a* from its respective revealed position back to its concealed position as the crank wheel 750 is rotated in the opposite direction from the second position to the first position. The moveable part 770*a* of the toy vehicle 720 has a first surface 772 visible on the vehicle 720 in at least the concealed position and a second surface 774 visible on the vehicle 720 only in the revealed position. Each of the first and second surfaces 772, 774 has sufficiently different features to differentiate from the other of the first and second surfaces 772, 774. The moveable accessory 770*d* is supported on at least one of the chassis 740 and the body 730 for movement between a stored position and an operated position. The moveable accessory 770*d* has the overall appearance of a ladder with a bucket 768 pivotally attached to the uppermost end. A pair of hose nozzles or water guns 769*a* protrude from sides of the bucket 768.

Similar to the fourth preferred embodiment, the first actuator mechanism 782 of the present embodiment is completely mechanically operated through forces provided by the user rotating the crank wheel 750 from the first position to the second position. The crank wheel 750 operates the first moveable part 770*a* and the moveable accessory 770*d*. The moveable accessory 770*d* rotates approximately 45-60 degrees in correspondence with rotation of the crank wheel 750 and simultaneously extends outwardly from the toy vehicle 720 (i.e., the moveable accessory 770*d* is an extensible, raiseable and rotatable ladder). The wheel activated toy vehicle 720 includes a motor 60 but the toy vehicle 720 is a free-wheeling vehicle. The second actuator mechanism 784 is operably coupled with the second and third moveable parts 770*b*-770*c*. The second actuator mechanism 784 is configured to move the second and third moveable parts 770*b*-770*c* from their respective concealed positions to their respective revealed positions and is configured to move the second and third moveable parts 770*b*-770*c* from their respective revealed positions back to their respective concealed positions after a predetermined period of time. The second actuator mechanism 784 comprises a gear train 785 which is in mesh with a shaft 62 of the motor 60. Preferably, the predetermined time is based upon a primary mechanical cam 786 operably coupled to the second actuator mechanism 784. When the user operates the pushbutton 752, the switch 95 is closed and the motor 60 begins to operate thereby causing the mechanical cam 786 to rotate and maintain the switch 95 closed. When the primary cam 786 rotates past its timing lobe 787, the switch 95 is no longer maintained closed (i.e., opens) and power is removed from the motor 60. Optionally, a secondary cam 788 is also operably coupled to the second actuator mechanism 784 and is linked to the third moveable part 770*c* in order to provide a slight delay before the third moveable part begins to move from the concealed position to the revealed position. The toy vehicle 720 does include a control circuit 90 (FIG. 16) having a battery or batteries BT mounted within at least one of the body 730 and the chassis 740, which is very similar to the control circuits 90 described above although either switch 95 or a rotary actuated switch 94 can initiate light and sound sequences. The crank wheel 750 operates the rotary actuated switch 94 when the crank wheel 750 is moved off the down travel-stop by a predetermined amount. The wheel activated toy vehicle 720 also includes a sound generator 92 electrically connected to the control circuit 90. Light beacons 735 are also electrically connected to the control circuit 90. When either switch 94 or 95 is closed, the batteries BT provide power to the control circuit 90. The control circuit 90 energizes the light beacons 735 causing them to illuminate or flash and simultaneously drives the sound generator 92 by playing sound bytes, music, horns and the like.

The first moveable part 770*a* is a hatch on top of the bucket 768 which rotates from a concealed position (FIG. 15A) to a revealed position (FIG. 15B). Under the first moveable part 770*a* is a first figurine 776*a* having the overall appearance of a fireman who appears to be operating the water guns 769*a* and which pops-up when the first moveable part 770*a* moves to the revealed position. The second moveable part 770*b* is a driver-side rear window which rotates from an "up" or concealed position (FIG. 15A) to an "out" or revealed position (FIG. 15B). Behind the second moveable part 770*b* is second figurine 776*b* having the overall appearance of a firehouse dog (e.g., a dalmatian). The third moveable part 770*c* is a driver-side rear panel which rotates from an "up" or concealed position (FIG. 15A) to an "out" or revealed position (FIG. 15B). Behind the third moveable part 770*c* is third figurine 776*c* having the overall appearance of a fireman laying down and operating another water gun 769*c*. The moveable accessory 770*d* moves from a lowered position (FIG. 15A) to a raised position (FIG. 15B) in relation to corresponding rotation of the crank wheel 750 by a user.

In use, a user rotates the crank wheel 750 from the first position (the down travel-stop) to the second position (the up travel-stop) thereby causing the first actuator mechanism 782 to cause the first moveable part 770*a* to move from the concealed position to the revealed position and the moveable accessory 770*d* to raise. Optionally, the moveable accessory 770*d* may also extend. When the crank wheel 750 comes off the down travel-stop by the predetermined amount, the rotary actuated switch 94 is closed thereby causing the control circuit 90 to energize the light beacons 735 and generate sound bytes on the sound generator 92. The first fireman figurine 776*a* pops-up from under the first moveable part 770*a*. Simultaneously, the moveable accessory 770*d* rotates approximately 45-60 degrees upon actuation of the crank wheel 750, i.e., a ladder 770*d* rotates from a lowered position resting on the roof 733 of the vehicle 720 up to a raised position. Multiple turns (full rotations) of the crank wheel 750 may be required to cause the moveable accessory 770*d* to move from the lowered position to the fully raised position. When the user operates the pushbutton 750, the dog figurine rotates out with the second moveable part 770*b* and after a slight delay time the other fireman figurine 676*c* rotates out with the third moveable part 670*b*. Rotating the crank wheel 750 in the opposite direction causes the first fireman figurine 776*a* to retract independently of the timing cam. Simultaneously the moveable accessory 770*d* lowers back down to the lowered position, i.e., resting on the roof 733 of the toy vehicle 720. When the crank wheel 750 reaches the down travel-stop, the switch 94 is no longer closed so the light beacons 735 and sound effects cease, although, alternatively, they can be set to cease upon expiration of a predetermined period of time by using a storage capacitor or the like. It is contemplated that the rotary actuated switch 94 could also initiate operation of the motor 60 for initiating operation of the second actuator mechanism 784 in addition to or in lieu of the pushbutton 752. Other combinations of switches would be obvious to one skilled in the art.

It will be appreciated by one skilled in the art, that while all of the manual actuator operators have been described herein as levers, pushbuttons and wheels, any manual actuator operator could be used, when appropriately disguised as a vehicle part or accessory, without departing from the broad inventive scope of the present invention.

From the foregoing it can be seen that the present invention comprises lever and wheel activated toy vehicles and toy vehicle accessories. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A lever activated toy vehicle comprising:

a body having a front end, a rear end, an interior and an exterior;

a chassis that accommodates the body and has at least a front wheel proximate the front end and a rear wheel proximate the rear end;

a motor disposed within one of the body and the chassis and drivingly coupled to at least one of the wheels;

a lever movably supported on one of the chassis and the body of the toy vehicle so as to be accessible by a user with the body and chassis joined together for movement between a first position and a second position by user manipulation of the lever;

a moveable part having at least a portion on the exterior of the body and a portion on the interior of the body, the moveable part being supported on at least one of the chassis and the body for movement between a concealed position and a revealed position, the moveable part has a first surface visible on the vehicle in at least the concealed position and a second surface visible on the vehicle only in the revealed position, each surface having sufficiently different features to differentiate the first and second surfaces; and an actuator mechanism operably coupled with the motor and the moveable part, the actuator mechanism being configured to move the moveable part from the concealed position to the revealed position by power from the motor after the lever is moved from the first position to the second position and being configured to move the moveable part from the revealed position back to the concealed position after a predetermined time.

2. The lever activated toy vehicle according to claim 1 further comprising a figurine disposed at least partially within the body of the vehicle, the figurine being hidden from view when the moveable part is in the concealed position and the figurine being viewable when the moveable part is in the revealed position.

3. The lever activated toy vehicle according to claim 2 wherein the figurine moves from a withdrawn position to an extended position when the moveable part moves from the concealed position to the revealed position.

4. The lever activated toy vehicle according to claim 1 further comprising a circuit having a battery mounted within at least one of the body and the chassis.

5. The lever activated toy vehicle according to claim 4 further comprising a sound generator electrically connected to the circuit.

6. The lever activated toy vehicle according to claim 4 further comprising a light electrically connected to the circuit.

7. The lever activated toy vehicle according to claim 1 further comprising a moveable accessory coupled to one of the lever, the actuator mechanism, a crank, and a wheel.

8. The lever activated toy vehicle according to claim 7 wherein the moveable accessory is one of an extension ladder, a bucket, and a truck bed.

9. The lever activated toy vehicle according to claim 1 wherein the moveable part is one of a door, a window, a hatch, a cap, a cab, and a roof.

10. The lever activated toy vehicle according to claim 1 wherein the body is one of a police vehicle, a fire vehicle, and a construction vehicle.

11. A lever activated toy vehicle comprising:

a body having a front end, a rear end, an interior and an exterior;

a chassis that accommodates the body and has at least a front wheel proximate the front end and a rear wheel proximate the rear end;

a lever movably supported on one of the chassis and the body of the toy vehicle so as to be accessible by a user with the body and chassis joined together for movement between a first position and a second position by user manipulation of the lever;

a moveable part having at least a portion on the exterior of the body and a portion on the interior of the body, the moveable part being supported on at least one of the chassis and the body for movement between a concealed position and a revealed position, the moveable part has a first surface visible on the vehicle in at least the concealed position and a second surface visible on the vehicle only in the revealed position, each surface having sufficiently different features to differentiate the first and second surfaces;

an actuator mechanism operably coupled with the lever and the moveable part, the actuator mechanism being configured to move the moveable part from the concealed position to the revealed position by mechanical translation after the lever is moved from the first position to the second position and being configured to move the moveable part from the revealed position back to the concealed position; and a moveable accessory operably coupled with one of the lever and the actuator mechanism, the moveable accessory being supported on at least one of the chassis and the body for movement between a stored position and an operated position, the moveable accessory moving from the stored position to the operated position as the lever moves from the first position to the second position and the moveable accessory moving from the operated position to the stored position as the lever moves from the second position to the first position.

12. The lever activated toy vehicle according to claim 11 further comprising a figurine disposed at least partially within the body of the vehicle, the figurine being hidden from view when the moveable part is in the concealed position and the figurine being viewable when the moveable part is in the revealed position.

13. The lever activated toy vehicle according to claim 12 wherein the figurine moves from a withdrawn position to an extended position when the moveable part moves from the concealed position to the revealed position.

14. The lever activated toy vehicle according to claim 11 further comprising a circuit having a battery mounted within at least one of the body and the chassis.

15. The lever activated toy vehicle according to claim 14 further comprising a sound generator electrically connected to the circuit.

16. The lever activated toy vehicle according to claim 14 further comprising a light electrically connected to the circuit.

17. The lever activated toy vehicle according to claim 11 wherein the moveable accessory is one of an extension ladder, a bucket, and a truck bed.

18. The lever activated toy vehicle according to claim 11 wherein the moveable part is one of a door, a window, a hatch, a cap, a cab, and a roof.

19. The lever activated toy vehicle according to claim 11 wherein the body is one of a police vehicle, a fire vehicle, and a construction vehicle.

20. A wheel activated toy vehicle comprising:

a body having a front end, a rear end, an interior and an exterior;

a chassis that accommodates the body and has at least a front wheel proximate the front end and a rear wheel proximate the rear end;

a crank wheel movably supported on one of the chassis and the body of the toy vehicle so as to be accessible by a user with the body and chassis joined together for movement between a first position and a second position by user manipulation of the crank wheel;

a moveable part having at least a portion on the exterior of the body and a portion on the interior of the body, the moveable part being supported on at least one of the chassis and the body for movement between a concealed position and a revealed position;

an actuator mechanism operably coupled with the crank wheel and the moveable part, the actuator mechanism being configured to move the moveable part from the concealed position to the revealed position by mechanical translation as the crank wheel is rotated from the first position to the second position and being configured to move the moveable part from the revealed position back to the concealed position as the crank wheel is rotated from the second position to the first position; and a moveable accessory operably coupled with one of the crank wheel and the actuator mechanism, the moveable accessory being supported on at least one of the chassis and the body for movement between a lowered position and a raised position, the moveable accessory moving in response to one of the crank wheel and the actuator mechanism.

21. The lever activated toy vehicle according to claim 1 wherein the motor is an electric motor.

* * * * *